US010481526B2

(12) United States Patent
Yamada

(10) Patent No.: US 10,481,526 B2
(45) Date of Patent: Nov. 19, 2019

(54) IMAGE-FORMING APPARATUS AND IMAGE-FORMING METHOD

(71) Applicant: FUJI XEROX CO., LTD., Tokyo (JP)

(72) Inventor: Yoshiteru Yamada, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/945,382

(22) Filed: Apr. 4, 2018

(65) Prior Publication Data

US 2019/0094761 A1 Mar. 28, 2019

(30) Foreign Application Priority Data

Sep. 27, 2017 (JP) ..... 2017-185833

(51) Int. Cl.
*G03G 15/10* (2006.01)
*G03G 15/00* (2006.01)
*G03G 15/08* (2006.01)

(52) U.S. Cl.
CPC ..... *G03G 15/105* (2013.01); *G03G 15/0877* (2013.01); *G03G 15/75* (2013.01); *G03G 15/0849* (2013.01); *G03G 15/101* (2013.01); *G03G 15/5033* (2013.01)

(58) Field of Classification Search
CPC ..... G03G 15/105; G03G 15/0849; G03G 15/0877; G03G 15/101
See application file for complete search history.

(56) References Cited

U.S. PATENT DOCUMENTS

| | | | | |
|---|---|---|---|---|
| 3,804,619 | A | 4/1974 | Mammino et al. | |
| 5,298,617 | A | 3/1994 | Nukada et al. | |
| 5,302,479 | A | 4/1994 | Daimon et al. | |
| 5,378,569 | A | 1/1995 | Nukada et al. | |
| 5,459,004 | A | 10/1995 | Katsumi et al. | |
| 2002/0159804 | A1* | 10/2002 | Azuma | G03G 5/0564 399/350 |

FOREIGN PATENT DOCUMENTS

| | | | |
|---|---|---|---|
| JP | 49-91231 | A | 8/1974 |
| JP | 56-040868 | A | 4/1981 |
| JP | 04-189873 | A | 7/1992 |

(Continued)

*Primary Examiner* — Thorl Chea
(74) *Attorney, Agent, or Firm* — Sughrue Mion, PLLC

(57) ABSTRACT

An image-forming apparatus includes an electrophotographic photosensitive member including a conductive base and a single-layer photosensitive layer disposed on the conductive base, the single-layer photosensitive layer including a binder resin, a charge-generating material, a hole-transporting material, and an electron-transporting material; and a developing unit including a developing roller that develops an electrostatic latent image formed on a surface of the electrophotographic photosensitive member with a developer including a toner in order to form a toner image, the developing roller being arranged to come into contact with the photosensitive layer. The ratio R/P of the content R [mass %] of the binder resin in the photosensitive layer to the pressing force P [N/mm] at which the developing roller is pressed against the photosensitive layer is about 11.5 or more and about 19.6 or less.

13 Claims, 2 Drawing Sheets

(56) References Cited

FOREIGN PATENT DOCUMENTS

| | | | |
|---|---|---|---|
| JP | 05-098181 | A | 4/1993 |
| JP | 05-140472 | A | 6/1993 |
| JP | 05-140473 | A | 6/1993 |
| JP | 05-263007 | A | 10/1993 |
| JP | 05-279591 | A | 10/1993 |
| JP | 2006-201742 | A | 8/2006 |
| JP | 2010-217769 | A | 9/2010 |
| JP | 2014-109683 | A | 6/2014 |

* cited by examiner

IMAGE-FORMING APPARATUS AND IMAGE-FORMING METHOD

CROSS-REFERENCE TO RELATED APPLICATIONS

This application is based on and claims priority under 35 USC 119 from Japanese Patent Application No. 2017-185833 filed Sep. 27, 2017.

BACKGROUND

Technical Field

The present invention relates to an image-forming apparatus and an image-forming method.

SUMMARY

According to an aspect of the invention, there is provided an image-forming apparatus including an electrophotographic photosensitive member including a conductive base and a single-layer photosensitive layer disposed on the conductive base, the single-layer photosensitive layer including a binder resin, a charge-generating material, a hole-transporting material, and an electron-transporting material; and a developing unit including a developing roller that develops an electrostatic latent image formed on a surface of the electrophotographic photosensitive member with a developer including a toner in order to form a toner image, the developing roller being arranged to come into contact with the photosensitive layer. The ratio R/P of the content R [mass %] of the binder resin in the photosensitive layer to the pressing force P [N/mm] at which the developing roller is pressed against the photosensitive layer is about 11.5 or more and about 19.6 or less.

BRIEF DESCRIPTION OF THE DRAWINGS

Exemplary embodiments of the present invention will be described in detail based on the following figures, wherein.

DETAILED DESCRIPTION

Figure 1:
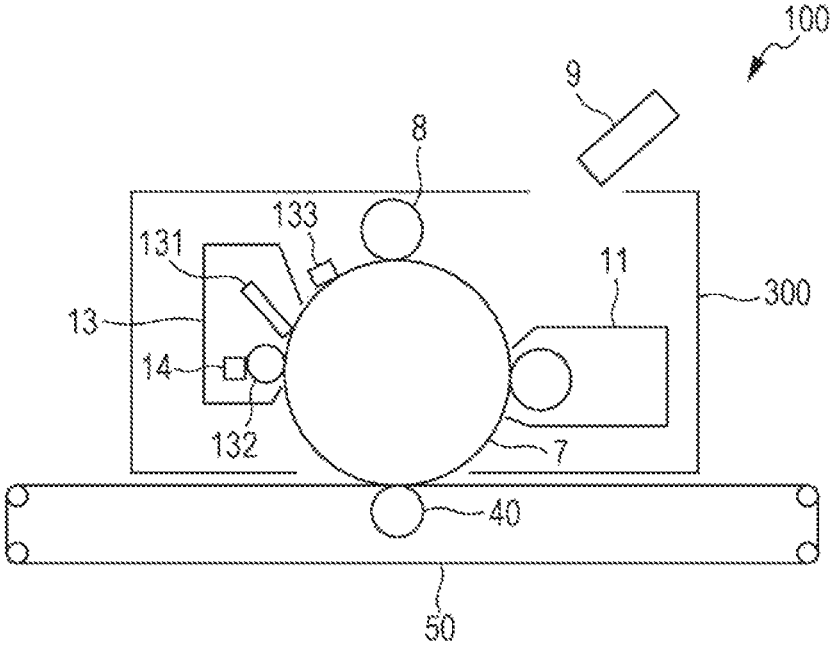
FIG. 1 is a schematic diagram illustrating an example of the structure of an image-forming apparatus according to an exemplary embodiment.

Exemplary embodiments of the invention are described below. The following description and examples are intended to be illustrative of the exemplary embodiments and not restrictive of the scope of the invention.

Hereinafter, when referring to the content of a constituent of a composition, in the case where the composition includes plural substances that serve as the constituent, the "content" of the constituent in the composition refers to the total content of the plural substances in the composition unless otherwise specified.

Hereinafter, a photosensitive layer constituted by a single layer is referred to as "single-layer photosensitive layer", and an electrophotographic photosensitive member is referred to simply as "photosensitive member". The single-layer photosensitive layer is a photosensitive layer having hole transportability and electron transportability in addition to charge generating ability.

Image-Forming Apparatus

An image-forming apparatus according to an exemplary embodiment includes an electrophotographic photosensitive member including a conductive base and a single-layer photosensitive layer disposed on the conductive base, the single-layer photosensitive layer including a binder resin, a charge-generating material, a hole-transporting material, and an electron-transporting material; and a developing unit including a developing roller that develops an electrostatic latent image formed on the surface of the electrophotographic photosensitive member with a developer including a toner in order to form a toner image, the developing roller being arranged to come into contact with the photosensitive layer. The ratio R/P of the content R [mass %] of the binder resin in the photosensitive layer to the pressing force P [N/mm] at which the developing roller is pressed against the photosensitive layer is 11.5 or more and 19.6 or less or about 11.5 or more and about 19.6 or less.

An image-forming apparatus that includes an electrophotographic photosensitive member including a single-layer photosensitive layer and a developing unit including a developing roller that develops an electrostatic latent image formed on the surface of the electrophotographic photosensitive member with a developer including a toner in order to form a toner image, the developing roller being arranged to come into contact with the photosensitive layer, has been proposed. When an image is repeatedly formed using the above image-forming apparatus, dot-like defects, such as black spots and white spots, may occur in the images.

The dot-like defects are often found when an image-forming apparatus that performs cleaning during development, that is, "cleanerless image-forming apparatus", is used.

The above-described image-forming apparatus according to an exemplary embodiment may reduce the occurrence of the dot-like defects in images formed using the image-forming apparatus. The reasons for this are presumably as follows.

Controlling the ratio R/P of the content R [mass %] of the binder resin in the photosensitive layer to the pressing force P [N/mm] at which the developing roller is pressed against the photosensitive layer to be within the above specific range may enhance the cleaning performance of the developing roller and accordingly reduce the amounts of paper dust particles, external additive particles, and unrecovered toner particles adhered onto the surface of the photosensitive layer in the repeated formation of images. This may effectively reduce the occurrence of the dot-like defects, such as black spots and white spots, in the images formed using the image-forming apparatus.

Since the developing roller has high cleaning performance, the image-forming apparatus according to an exemplary embodiment may effectively reduce the occurrence of the dot-like defects in images formed using the image-forming apparatus even when the image-forming apparatus is an image-forming apparatus that performs cleaning during development.

The image-forming apparatus according to an exemplary embodiment is described below in detail.

In the image-forming apparatus according to an exemplary embodiment, the ratio R/P of the content R [mass %] of the binder resin in the photosensitive layer to the pressing force P [N/mm] at which the developing roller is pressed against the photosensitive layer is 11.5 or more and 19.6 or less or about 11.5 or more and about 19.6 or less. The ratio R/P is preferably 11.5 or more and 15.0 or less and is more preferably 11.5 or more and 13.0 or less in order to reduce the occurrence of the dot-like defects in images formed using the image-forming apparatus.

The content R of the binder resin in the photosensitive layer is preferably 45% by mass or more or about 45% by mass or more, is more preferably 45% by mass or more and 75% by mass or less, and is particularly preferably 45% by mass or more and 60% by mass or less or about 45% by mass or more and about 60% by mass or less in order to reduce the occurrence of the dot-like defects in images formed using the image-forming apparatus.

The pressing force P at which the developing roller is pressed against the photosensitive layer is preferably 2.0 N/mm or more and 7.0 N/mm or less, is more preferably 2.5 N/mm or more and 6.5 N/mm or less or about 2.5 N/mm or more and about 6.5 N/mm or less, and is particularly preferably 3.0 N/mm or more and 5.5 N/mm or less or about 3.0 N/mm or more and about 5.5 N/mm or less in order to reduce the occurrence of the dot-like defects in images formed using the image-forming apparatus.

The pressing force P may be nip pressure.

In this exemplary embodiment, the pressing force P at which the developing roller is pressed against the photosensitive layer is determined using a digital force gauge produced by IMADA CO., LTD.

The pressing force P may be adjusted by, for example, measuring the spring constant of a spring by which the developing roller is pressed with a digital force gauge produced by IMADA CO., LTD. and changing the length of the spring such that the desired pressing force is achieved.

Developing Unit and Developing Roller

The image-forming apparatus according to an exemplary embodiment includes a developing unit including a developing roller that develops an electrostatic latent image formed on the surface of the electrophotographic photosensitive member in order to form a toner image, the developing roller being arranged to come into contact with the photosensitive layer.

The developing unit used in this exemplary embodiment may be any developing unit that includes a developing roller that develops an electrostatic latent image formed on the surface of the electrophotographic photosensitive member in order to form a toner image, the developing roller being arranged to come into contact with the photosensitive layer of the electrophotographic photosensitive member; known developing units may be used.

The developing roller used in this exemplary embodiment is not limited; known developing rollers may be used.

The developing roller may include a support (i.e., a core). The developing roller may be a cylindrical or tubular member.

The support of the developing roller is a member that serves as a supporting member.

Examples of the support include a member composed of a metal, such as iron (e.g., free-cutting steel), copper, brass, stainless steel, aluminum, or nickel.

Examples of the support further include a member composed of a resin, a ceramic, or the like which is provided with a plating film deposited on the outer periphery of the member; a member that has been subjected to an oxidation treatment; and a member composed of a resin, a ceramic, or the like which includes a conductant agent dispersed therein.

The support may be either a hollow member (i.e., a tubular member) or a nonhollow member.

The size of the support is not limited and may be set appropriately in accordance with the intended purpose.

The developing roller may include an elastic layer disposed on the support.

The elastic layer is not limited; known elastic layers may be used.

Examples of a material for the elastic layer include a silicone rubber, a urethane rubber, a nitrile rubber, a chloroprene rubber, a hydrogenated nitrile rubber, a styrene-butadiene rubber, an epichlorohydrin rubber, and an ethylene-propylene-diene rubber.

The elastic layer may optionally have electrical conductivity.

An additive used for imparting electrical conductivity to the elastic layer is not limited; known conductant agents may be used. Examples of the conductant agents include an electron conductant agent, such as carbon black, and an ion conductant agent, such as a quaternary ammonium salt.

The elastic layer may optionally include various additives such as a filler, a bulking agent, a reinforcing agent, a processing aid, a curing agent, a vulcanization accelerator, a crosslinking agent, a crosslinking aid, an antioxidant, a plasticizer, an ultraviolet absorber, a pigment, a silicone oil, an auxiliary, and a surfactant.

The thickness of the elastic layer is not limited and may be set appropriately in accordance with the intended purpose. The thickness of the elastic layer may be 0.1 to 10 mm.

The developing roller may further include an additional layer disposed on the support or the elastic layer. Examples of the additional layer include known layers such as a conductive layer and a protection layer.

The developing roller may include an adhesive layer interposed between the support and the elastic layer. The material for the adhesive layer is not limited; known materials may be used.

Electrophotographic Photosensitive Member

The electrophotographic photosensitive member used in this exemplary embodiment includes a conductive base and a single-layer photosensitive layer disposed on the conductive base. The single-layer photosensitive layer includes a binder resin, a charge-generating material, a hole-transporting material, and an electron-transporting material.

Conductive Base

Examples of the conductive base include a metal sheet, a metal drum, and a metal belt that are made of a metal, such as aluminum, copper, zinc, chromium, nickel, molybdenum, vanadium, indium, gold, or platinum, or an alloy, such as stainless steel. Examples of the conductive base further include a paper sheet, a resin film, and a belt on which a conductive compound, such as a conductive polymer or indium oxide, a metal, such as aluminum, palladium, or gold, or an alloy is deposited by coating, vapor deposition, or lamination. The term "conductive" used herein refers to having a volume resistivity of less than $1\times10^{13}$ Ωcm.

In the case where the photosensitive member is used as a component of a laser printer, the surface of the conductive base may be roughened such that the center-line average roughness Ra of the surface of the conductive base is 0.04 μm or more and 0.5 μm or less in order to reduce the likelihood of interference fringes being formed upon the photosensitive member being irradiated with a laser beam. Although it is not necessary to roughen the surface of the conductive base in order to reduce the formation of interference fringes in the case when an incoherent light source is used, roughening the surface of the conductive base may increase the service life of the photosensitive member by reducing the occurrence of defects caused by the irregularities formed in the surface of the conductive base.

For roughening the surface of the conductive base, for example, the following methods may be used: wet honing in which a suspension prepared by suspending abrasive particles in water is blown onto the surface of the conductive base; centerless grinding in which the conductive base is continuously ground with rotating grinding wheels brought into pressure contact with the conductive base; and an anodic oxidation treatment.

Examples of the roughening method further include a method in which, instead of roughening the surface of the conductive base, a layer is formed on the surface of the conductive base by using a resin including conductive or semiconductive powder particles dispersed therein such that a rough surface is formed due to the particles dispersed in the layer.

In the roughening treatment using anodic oxidation, an oxidation film is formed on the surface of a conductive base made of a metal, such as aluminum, by performing anodic oxidation using the conductive base as an anode in an electrolyte solution. Examples of the electrolyte solution include a sulfuric acid solution and an oxalic acid solution. A porous anodic oxidation film formed by anodic oxidation is originally chemically active and likely to become contaminated. In addition, the resistance of the porous anodic oxidation film is likely to vary widely with the environment. Accordingly, the porous anodic oxidation film may be subjected to a pore-sealing treatment in which micropores formed in the oxide film are sealed using volume expansion caused by a hydration reaction of the oxidation film in steam under pressure or in boiled water that may include a salt of a metal, such as nickel, so as to be converted into a more stable hydrous oxide film.

The thickness of the anodic oxidation film may be, for example, 0.3 μm or more and 15 μm or less. When the thickness of the anodic oxidation film falls within the above range, the anodic oxidation film may serve as a barrier to injection. Furthermore, an increase in the residual potential that remains after the repeated use of the photosensitive member may be limited.

The conductive base may be subjected to a treatment in which an acidic treatment liquid is used or a boehmite treatment.

The treatment in which an acidic treatment liquid is used is performed in, for example, the following manner. An acidic treatment liquid that includes phosphoric acid, chromium acid, and hydrofluoric acid is prepared. The proportions of the phosphoric acid, chromium acid, and hydrofluoric acid in the acidic treatment liquid may be, for example, 10% by mass or more and 11% by mass or less, 3% by mass or more and 5% by mass or less, and 0.5% by mass or more and 2% by mass or less, respectively. The total concentration of the above acids may be 13.5% by mass or more and 18% by mass or less. The treatment temperature may be, for example, 42° C. or more and 48° C. or less. The thickness of the resulting coating film may be 0.3 μm or more and 15 μm or less.

In the boehmite treatment, for example, the conductive base is immersed in pure water having a temperature of 90° C. or more and 100° C. or less for 5 to 60 minutes or brought into contact with steam having a temperature of 90° C. or more and 120° C. or less for 5 to 60 minutes. The thickness of the resulting coating film may be 0.1 μm or more and 5 μm or less. The coating film may optionally be subjected to an anodic oxidation treatment with an electrolyte solution in which the coating film is hardly soluble, such as adipic acid, boric acid, a boric acid salt, a phosphoric acid salt, a phthalic acid salt, a maleic acid salt, a benzoic acid salt, a tartaric acid salt, or a citric acid salt.

Single-Layer Photosensitive Layer

The single-layer photosensitive layer according to an exemplary embodiment includes a binder resin, a charge-generating material, a hole-transporting material, and an electron-transporting material.

Binder Resin

Examples of the binder resin include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone-alkyd resin, a phenol-formaldehyde resin, a styrene-alkyd resin, a poly-N-vinylcarbazole, and polysilane. The above binder resins may be used alone or in combination of two or more.

The binder resin is preferably at least one resin selected from the group consisting of a polycarbonate resin, a polyester resin, and a polyarylate resin, is more preferably a polycarbonate resin, and is particularly preferably a bisphenol Z polycarbonate resin in order to reduce the occurrence of the dot-like defects in images formed using the image-forming apparatus.

The bisphenol Z polycarbonate resin is a polycarbonate resin having a structure formed by removing hydrogen atoms from the two hydroxyl groups of a bisphenol Z structure, that is, 1,1-bis(4-hydroxyphenyl)cyclohexane.

The viscosity-average molecular weight of the binder resin may be 30,000 or more and 80,000 or less in order to enhance the formability of the photosensitive layer.

The content R of the binder resin in the photosensitive layer may be within the above-described range.

Charge-Generating Material

Examples of the charge-generating material include azo pigments, such as bisazo and trisazo; annulated aromatic pigments, such as dibromoanthanthrone; perylene pigments; pyrrolopyrrole pigments; phthalocyanine pigments; zinc oxide; and trigonal selenium.

The charge-generating material may be a phthalocyanine pigment in order to increase the sensitivity of the photosensitive layer. Specific examples of phthalocyanine pigments include hydroxygallium phthalocyanine disclosed in, for example, Japanese Unexamined Patent Application Publication No. 5-263007 and Japanese Unexamined Patent Application Publication No. 5-279591; chlorogallium phthalocyanine disclosed in, for example, Japanese Unexamined Patent Application Publication No. 5-98181; dichloro tin phthalocyanine disclosed in, for example, Japanese Unexamined Patent Application Publication No. 5-140472 and Japanese Unexamined Patent Application Publication No. 5-140473; and titanyl phthalocyanine disclosed in, for example, Japanese Unexamined Patent Application Publication No. 4-189873.

The charge-generating material is preferably at least one selected from hydroxygallium phthalocyanine and chlorogallium phthalocyanine, is more preferably hydroxygallium phthalocyanine, and is further preferably Type-V hydroxygallium phthalocyanine in order to increase the efficiency of generation of electric charge.

Hydroxygallium phthalocyanine having a maximum peak wavelength at 810 to 839 nm in an absorption spectrum that covers a wavelength range of 600 to 900 nm may be used in order to increase the efficiency of generation of electric charge.

The average particle size and BET specific surface area of the hydroxygallium phthalocyanine having a maximum peak wavelength at 810 to 839 nm may fall within specific ranges. Specifically, the average particle size of the above hydroxygallium phthalocyanine is preferably 0.20 μm or less and is more preferably 0.01 μm or more and 0.15 μm or less. The BET specific surface area of the above hydroxygallium phthalocyanine is preferably 45 $m^2/g$ or more, is more preferably 50 $m^2/g$ or more, and is further preferably 55 $m^2/g$ or more and 120 $m^2/g$ or less. The term "average particle size" used herein refers to volume-average particle size measured by a laser diffraction/scattering particle size distribution analyzer "LA-700" produced by HORIBA, Ltd. The term "BET specific surface area" used herein refers to BET specific surface area measured by nitrogen purging using a flow specific surface area automatic analyzer "Flow-Sorb 112300" produced by Shimadzu Corporation.

The maximum particle size (i.e., the maximum primary-particle size) of the hydroxygallium phthalocyanine is preferably 1.2 μm or less, is more preferably 1.0 μm or less, and is further preferably 0.3 μm or less.

The hydroxygallium phthalocyanine may have an average particle size of 0.2 μm or less, a maximum particle size of 1.2 μm or less, and a specific surface area of 45 $m^2/g$ or more.

The hydroxygallium phthalocyanine may be Type-V hydroxygallium phthalocyanine having a diffraction peak at, at least, Bragg angles (2θ±0.2°) of 7.3°, 16.0°, 24.9°, and 28.0° in an X-ray diffraction spectrum measured with the CuKα radiation.

The chlorogallium phthalocyanine may be a compound having a diffraction peak at Bragg angles (2θ±0.2°) of 7.4°, 16.6°, 25.5°, and 28.3° in order to increase the sensitivity of the photosensitive layer. The suitable maximum peak wavelength, suitable average particle size, suitable maximum particle size, and suitable BET specific surface area of the chlorogallium phthalocyanine are the same as those of the hydroxygallium phthalocyanine.

The above charge-generating materials may be used alone or in combination of two or more.

The amount of the charge-generating material included in the single-layer photosensitive layer is preferably 0.1% by mass or more and 10% by mass or less, is more preferably 0.5% by mass or more and 5% by mass or less, and is particularly preferably 1% by mass or more and 3% by mass or less of the total amount of the photosensitive layer.

Hole-Transporting Material

Examples of the hole-transporting material include triarylamines, benzidines, arylalkanes, aryl-substituted ethylenes, stilbenes, anthracenes, and hydrazones. The above hole-transporting materials may be used alone or in combination of two or more.

Specific examples of the hole-transporting material include the compounds represented by General Formulae (B-1) to (B-3) below and the compound represented by General Formula (1) below. Among the above compounds, the compound represented by General Formula (1) may be used in order to increase the sensitivity of the photosensitive layer.

(B-1)

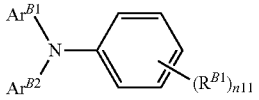

In General Formula (B-1), $R^{B1}$ represents a methyl group; n11 represents an integer of 0 to 2; and $Ar^{B1}$ and $Ar^{B2}$ each independently represent an unsubstituted or substituted aryl group, a $—C_6H_4—C(R^{B3})=C(R^{B4})(R^{B5})$ group, or a $—C_6H_4—CH=CH—CH=C(R^{B6})(R^{B7})$ group, where $R^{B3}$ to $R^{B7}$ each independently represent a hydrogen atom, an unsubstituted or substituted alkyl group, or an unsubstituted or substituted aryl group. Examples of a group with which the above groups may be substituted include a halogen atom, an alkyl group having 1 to 5 carbon atoms, an alkoxy group having 1 to 5 carbon atoms, and an amino group substituted with an alkyl group having 1 to 3 carbon atoms.

(B-2)

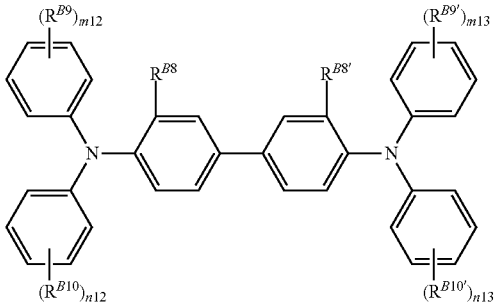

In General Formula (B-2), $R^{B8}$ and $R^{B8'}$ each independently represent a hydrogen atom, a halogen atom, an alkyl group having 1 to 5 carbon atoms, or an alkoxy group having 1 to 5 carbon atoms; $R^{B9}$, $R^{B9'}$, $R^{B10}$, and $R^{B10'}$ each independently represent a halogen atom, an alkyl group having 1 to 5 carbon atoms, an alkoxy group having 1 to 5 carbon atoms, an amino group substituted with an alkyl group having 1 or 2 carbon atoms, an unsubstituted or substituted aryl group, a $—C(R^{B11})=C(R^{B12})(R^{B13})$ group, or a $—CH=CH—CH=C(R^{B14})(R^{B15})$ group, where $R^{B11}$ to $R^{B15}$ are each independently a hydrogen atom, an unsubstituted or substituted alkyl group, or an unsubstituted or substituted aryl group; and m12, m13, n12, and n13 each independently represent an integer of 0 to 2. Examples of a group with which the above groups may be substituted include a halogen atom, an alkyl group having 1 to 5 carbon atoms, an alkoxy group having 1 to 5 carbon atoms, and an amino group substituted with an alkyl group having 1 to 3 carbon atoms.

(B-3)

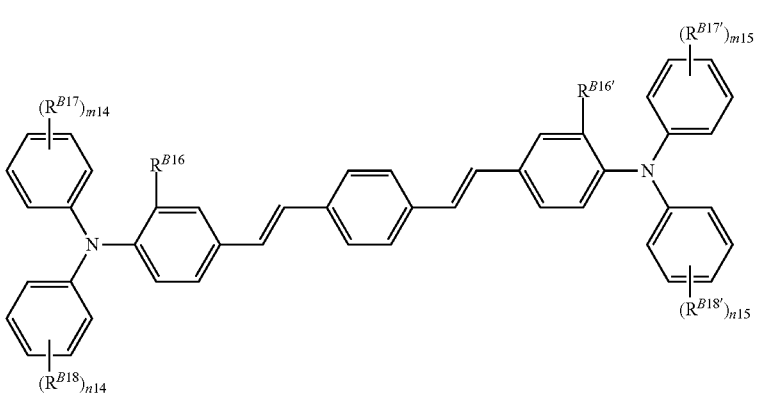

In General Formula (B-3), $R^{B16}$ and $R^{B16'}$ each independently represent a hydrogen atom, a halogen atom, an alkyl group having 1 to 5 carbon atoms, or an alkoxy group having 1 to 5 carbon atoms; $R^{B17}$, $R^{B17'}$, $R^{B18}$, and $R^{B18'}$ each independently represent a halogen atom, an alkyl group having 1 to 5 carbon atoms, an alkoxy group having 1 to 5 carbon atoms, an amino group substituted with an alkyl group having 1 or 2 carbon atoms, an unsubstituted or substituted aryl group, a —C($R^{B19}$)═C($R^{B20}$)($R^{B21}$) group, or a —CH═CH—CH═C($R^{B22}$)($R^{B23}$) group, where $R^{B19}$ to $R^{B23}$ are each independently a hydrogen atom, an unsubstituted or substituted alkyl group, or an unsubstituted or substituted aryl group; and m14, m15, n14, and n15 are each independently an integer of 0 to 2. Examples of a group with which the above groups may be substituted include a halogen atom, an alkyl group having 1 to 5 carbon atoms, an alkoxy group having 1 to 5 carbon atoms, and an amino group substituted with an alkyl group having 1 to 3 carbon atoms. The hole-transporting material may be the compound represented by General Formula (1) below in order to increase the sensitivity of the photosensitive layer.

(1)

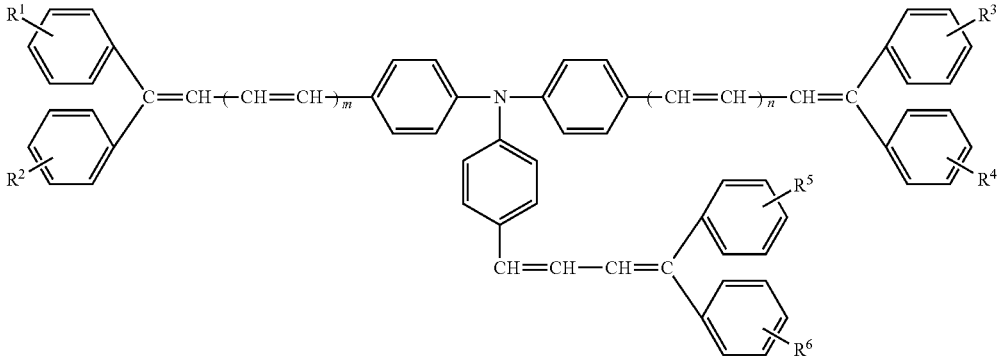

In General Formula (1), $R^1$, $R^2$, $R^3$, $R^4$, $R^5$, and $R^6$ each independently represent a hydrogen atom, a halogen atom, an alkyl group, an alkoxy group, a phenyl group, or a phenoxy group; and m and n are each independently 0 or 1.

Examples of the halogen atom represented by $R^1$ to $R^6$ in General Formula (1) include a fluorine atom, a chlorine atom, a bromine atom, and an iodine atom. Among the halogen atoms, a fluorine atom and a chlorine atom are preferable, and a chlorine atom is more preferable.

Examples of the alkyl group represented by $R^1$ to $R^6$ in General Formula (1) include linear and branched alkyl groups having 1 to 20 (preferably 1 to 6, more preferably 1 to 4, further preferably 1 to 3) carbon atoms. Examples of the linear alkyl groups include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group. Examples of the branched alkyl groups include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, and a neoicosyl group. Among the above alkyl groups, in particular, a methyl group and an ethyl group may be used.

Examples of the alkoxy group represented by $R^1$ to $R^6$ in General Formula (1) include linear and branched alkoxy groups having 1 to 20 (preferably 1 to 6, more preferably 1 to 4, further preferably 1 to 3) carbon atoms. Examples of the linear alkoxy groups include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, an n-nonadecyloxy group, and an n-icosyloxy group. Examples of the branched alkoxy groups include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, and a neoicosyloxy group. Among the above alkoxy groups, in particular, a methoxy group may be used.

The phenyl group represented by $R^1$ to $R^6$ in General Formula (1) may include 1 to 5 (preferably 1 or 2) substituent groups. Examples of the substituent group include linear and branched alkyl groups having 1 to 4 carbon atoms, such as a methyl group and an ethyl group; linear and branched alkoxy groups having 1 to 4 carbon atoms, such as a methoxy group and an ethoxy group; and halogen atoms, such as a fluorine atom and a chlorine atom.

The phenoxy group represented by $R^1$ to $R^6$ in General Formula (1) may include 1 to 5 (preferably 1 or 2) substituent groups attached to the benzene ring. Examples of the substituent group include linear and branched alkyl groups having 1 to 4 carbon atoms, such as a methyl group and an ethyl group; linear and branched alkoxy groups having 1 to 4 carbon atoms, such as a methoxy group and an ethoxy group; and halogen atoms, such as a fluorine atom and a chlorine atom.

In General Formula (1), m and n are each independently 0 or 1. In order to increase the sensitivity of the photosensitive layer, both m and n are preferably 0 or 1 and are more preferably 1.

In the compound represented by General Formula (1), $R^1$ to $R^6$ may each independently represent a hydrogen atom, an alkyl group having 1 to 4 carbon atoms, or an alkoxy group having 1 to 4 carbon atoms and both m and n may represent 0 or 1 in order to increase the sensitivity of the photosensitive layer.

Specific examples of the compound represented by General Formula (1) include, but are not limited to, the following exemplary compounds. The numbers attached to the substituent groups each refer to the position at which the substituent group is attached to a benzene ring.

TABLE 1

| Exemplary compound | m | n | $R^1$ | $R^2$ | $R^3$ | $R^4$ | $R^5$ | $R^6$ |
|---|---|---|---|---|---|---|---|---|
| 1-1 | 1 | 1 | H | H | H | H | H | H |
| 1-2 | 1 | 1 | 4-$CH_3$ | 4-$CH_3$ | 4-$CH_3$ | 4-$CH_3$ | 4-$CH_3$ | 4-$CH_3$ |
| 1-3 | 1 | 1 | 4-$CH_3$ | 4-$CH_3$ | H | H | 4-$CH_3$ | 4-$CH_3$ |
| 1-4 | 1 | 1 | 4-$CH_3$ | H | 4-$CH_3$ | H | 4-$CH_3$ | H |
| 1-5 | 1 | 1 | H | H | 4-$CH_3$ | 4-$CH_3$ | H | H |
| 1-6 | 1 | 1 | 3-$CH_3$ | 3-$CH_3$ | 3-$CH_3$ | 3-$CH_3$ | 3-$CH_3$ | 3-$CH_3$ |
| 1-7 | 1 | 1 | H | H | H | H | 4-Cl | 4-Cl |
| 1-8 | 1 | 1 | 4-$OCH_3$ | H | 4-$OCH_3$ | H | 4-$OCH_3$ | H |
| 1-9 | 1 | 1 | H | H | H | H | 4-$OCH_3$ | 4-$OCH_3$ |
| 1-10 | 1 | 1 | 4-$OCH_3$ | 4-$OCH_3$ | 4-$OCH_3$ | 4-$OCH_3$ | 4-$OCH_3$ | 4-$OCH_3$ |
| 1-11 | 1 | 1 | 4-$OCH_3$ | H | 4-$OCH_3$ | H | 4-$OCH_3$ | 4-$OCH_3$ |
| 1-12 | 1 | 1 | 4-$CH_3$ | H | 4-$CH_3$ | H | 4-$CH_3$ | 4-F |
| 1-13 | 1 | 1 | 3-$CH_3$ | H | 3-$CH_3$ | H | 3-$CH_3$ | H |
| 1-14 | 1 | 1 | 4-Cl | H | 4-Cl | H | 4-Cl | H |
| 1-15 | 1 | 1 | 4-Cl | 4-Cl | 4-Cl | 4-Cl | 4 Cl | 4-Cl |
| 1-16 | 1 | 1 | 3-$CH_3$ | 3-$CH_3$ | 3-$CH_3$ | 3-$CH_3$ | 3-$CH_3$ | 3-$CH_3$ |
| 1-17 | 1 | 1 | 4-$CH_3$ | 4-$OCH_3$ | 4-$CH_3$ | 4-$OCH_3$ | 4-$CH_3$ | 4-$OCH_3$ |
| 1-18 | 1 | 1 | 3-$CH_3$ | 4-$OCH_3$ | 3-$CH_3$ | 4-$OCH_3$ | 3-$CH_3$ | 4-$OCH_3$ |
| 1-19 | 1 | 1 | 3-$CH_3$ | 4-Cl | 3-$CH_3$ | 4-Cl | 3-$CH_3$ | 4-Cl |
| 1-20 | 1 | 1 | 4-$CH_3$ | 4-Cl | 4-$CH_3$ | 4-Cl | 4-$CH_3$ | 4-Cl |

TABLE 2

| Exemplary compound | m | n | $R^1$ | $R^2$ | $R^3$ | $R^4$ | $R^5$ | $R^6$ |
|---|---|---|---|---|---|---|---|---|
| 1-21 | 1 | 0 | H | H | H | H | H | H |
| 1-22 | 1 | 0 | 4-$CH_3$ | 4-$CH_3$ | 4-$CH_3$ | 4-$CH_3$ | 4-$CH_3$ | 4-$CH_3$ |
| 1-23 | 1 | 0 | 4-$CH_3$ | 4-$CH_3$ | H | H | 4-$CH_3$ | 4-$CH_3$ |
| 1-24 | 1 | 0 | H | H | 4-$CH_3$ | 4-$CH_3$ | H | H |
| 1-25 | 1 | 0 | H | H | 3-$CH_3$ | 3-$CH_3$ | H | H |
| 1-26 | 1 | 0 | H | H | 4-Cl | 4-Cl | H | H |
| 1-27 | 1 | 0 | 4-$CH_3$ | H | H | H | 4-$CH_3$ | H |
| 1-28 | 1 | 0 | 4-$OCH_3$ | H | H | H | 4-$OCH_3$ | H |
| 1-29 | 1 | 0 | H | H | 4-$OCH_3$ | 4-$OCH_3$ | H | H |
| 1-30 | 1 | 0 | 4-$OCH_3$ | 4-$OCH_3$ | 4-$OCH_3$ | 4-$OCH_3$ | 4-$OCH_3$ | 4-$OCH_3$ |
| 1-31 | 1 | 0 | 4-$OCH_3$ | H | 4-$OCH_3$ | H | 4-$OCH_3$ | 4-$OCH_3$ |
| 1-32 | 1 | 0 | 4-$CH_3$ | H | 4-$CH_3$ | H | 4-$CH_3$ | 4-F |
| 1-33 | 1 | 0 | 3-$CH_3$ | H | 3-$CH_3$ | H | 3-$CH_3$ | H |
| 1-34 | 1 | 0 | 4-Cl | H | 4-Cl | H | 4-Cl | H |
| 1-35 | 1 | 0 | 4-Cl | 4-Cl | 4-Cl | 4-Cl | 4-Cl | 4-Cl |
| 1-36 | 1 | 0 | 3-$CH_3$ | 3-$CH_3$ | 3-$CH_3$ | 3-$CH_3$ | 3-$CH_3$ | 3-$CH_3$ |
| 1-37 | 1 | 0 | 4-$CH_3$ | 4-$OCH_3$ | 4-$CH_3$ | 4-$OCH_3$ | 4-$CH_3$ | 4-$OCH_3$ |
| 1-38 | 1 | 0 | 3-$CH_3$ | 4-$OCH_3$ | 3-$CH_3$ | 4-$OCH_3$ | 3-$CH_3$ | 4-$OCH_3$ |
| 1-39 | 1 | 0 | 3-$CH_3$ | 4-Cl | 3-$CH_3$ | 4-Cl | 3-$CH_3$ | 4-Cl |
| 1-40 | 1 | 0 | 4-$CH_3$ | 4-Cl | 4-$CH_3$ | 4-Cl | 4-$CH_3$ | 4-Cl |

TABLE 3

| Exemplary compound | m | n | $R^1$ | $R^2$ | $R^3$ | $R^4$ | $R^5$ | $R^6$ |
|---|---|---|---|---|---|---|---|---|
| 1-41 | 0 | 0 | H | H | H | H | H | H |
| 1-42 | 0 | 0 | 4-$CH_3$ | 4-$CH_3$ | 4-$CH_3$ | 4-$CH_3$ | 4-$CH_3$ | 4-$CH_3$ |
| 1-43 | 0 | 0 | 4-$CH_3$ | 4-$CH_3$ | 4-$CH_3$ | 4-$CH_3$ | H | H |
| 1-44 | 0 | 0 | 4-$CH_3$ | H | 4-$CH_3$ | H | H | H |
| 1-45 | 0 | 0 | H | H | H | H | 4-$CH_3$ | 4-$CH_3$ |
| 1-46 | 0 | 0 | 3-$CH_3$ | 3-$CH_3$ | 3-$CH_3$ | 3-$CH_3$ | H | H |
| 1-47 | 0 | 0 | H | H | H | H | 4-Cl | 4-Cl |
| 1-48 | 0 | 0 | 4-$OCH_3$ | H | 4-$OCH_3$ | H | H | H |
| 1-49 | 0 | 0 | H | H | H | H | 4-$OCH_3$ | 4-$OCH_3$ |
| 1-50 | 0 | 0 | 4-$OCH_3$ | 4-$OCH_3$ | 4-$OCH_3$ | 4-$OCH_3$ | 4-$OCH_3$ | 4-$OCH_3$ |
| 1-51 | 0 | 0 | 4-$OCH_3$ | H | 4-$OCH_3$ | H | 4-$OCH_3$ | 4-$OCH_3$ |
| 1-52 | 0 | 0 | 4-$CH_3$ | H | 4-$CH_3$ | H | 4-$CH_3$ | 4-F |
| 1-53 | 0 | 0 | 3-$CH_3$ | H | 3-$CH_3$ | H | 3-$CH_3$ | H |
| 1-54 | 0 | 0 | 4-Cl | H | 4-Cl | H | 4-Cl | H |
| 1-55 | 0 | 0 | 4-Cl | 4-Cl | 4-Cl | 4-Cl | 4-Cl | 4-Cl |
| 1-56 | 0 | 0 | 3-$CH_3$ | 3-$CH_3$ | 3-$CH_3$ | 3-$CH_3$ | 3-$CH_3$ | 3-$CH_3$ |
| 1-57 | 0 | 0 | 4-$CH_3$ | 4-$OCH_3$ | 4-$CH_3$ | 4-$OCH_3$ | 4-$CH_3$ | 4-$OCH_3$ |
| 1-58 | 0 | 0 | 3-$CH_3$ | 4-$OCH_3$ | 3-$CH_3$ | 4-$OCH_3$ | 3-$CH_3$ | 4-$OCH_3$ |
| 1-59 | 0 | 0 | 3-$CH_3$ | 4-Cl | 3-$CH_3$ | 4-Cl | 3-$CH_3$ | 4-Cl |
| 1-60 | 0 | 0 | 4-$CH_3$ | 4-Cl | 4-$CH_3$ | 4-Cl | 4-$CH_3$ | 4-Cl |

TABLE 4

| Exemplary compound | m | n | $R^1$ | $R^2$ | $R^3$ | $R^4$ | $R^5$ | $R^6$ |
|---|---|---|---|---|---|---|---|---|
| 1-61 | 1 | 1 | 4-$C_3H_7$ | 4-$C_3H_7$ | 4-$C_3H_7$ | 4-$C_3H_7$ | 4-$C_3H_7$ | 4-$C_3H_7$ |
| 1-62 | 1 | 1 | 4-$OC_6H_5$ | 4-$OC_6H_5$ | 4-$OC_6H_5$ | 4-$OC_6H_5$ | 4-$OC_6H_5$ | 4-$OC_6H_5$ |
| 1-63 | 1 | 1 | H | 4-$CH_3$ | H | 4-$CH_3$ | H | 4-$CH_3$ |
| 1-64 | 1 | 1 | 4-$C_6H_5$ | 4-$C_6H_5$ | 4-$C_6H_5$ | 4-$C_6H_5$ | 4-$C_6H_5$ | 4-$C_6H_5$ |

Only one compound represented by General Formula (1) may be used alone. Alternatively, two or more compounds represented by General Formula (1) may be used in combination with one another. When the compound represented by General Formula (1) is used, another hole-transporting material may be used in combination with the compound represented by General Formula (1). In the case where another hole-transporting material is used in combination with the compound represented by General Formula (1), the amount of the compound represented by General Formula (1) may be 75% by mass or more of the total amount of the hole-transporting materials.

The amount of the hole-transporting material is preferably 20% by mass or more and 40% by mass or less and is more preferably 25% by mass or more and 30% by mass or less of the amount of the photosensitive layer.

Electron-Transporting Material

Examples of the electron-transporting material include quinones, such as p-benzoquinone, chloranil, bromanil, and anthraquinone; tetracyanoquinodimethane compounds; fluorenones, such as 2,4,7-trinitrofluorenone; xanthones; benzophenones; cyanovinyl compounds; and ethylenes. The above electron-transporting materials may be used alone or in combination of two or more.

The electron-transporting material is preferably a fluorenone in order to increase the sensitivity of the photosensitive layer. Among fluorenones, the compound represented by General Formula (2) is particularly preferable.

(2)

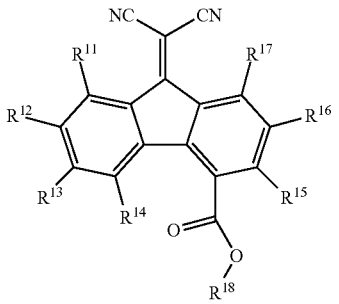

In General Formula (2), $R^{11}$, $R^{12}$, $R^{13}$, $R^{14}$, $R^{15}$, $R^{16}$, and $R^{17}$ each independently represent a hydrogen atom, a halogen atom, an alkyl group, an alkoxy group, an aryl group, or an aralkyl group; and $R^{18}$ represents an alkyl group, an aryl group, an aralkyl group, or a $-L^{19}-O-R^{20}$ group, where $L^{19}$ is an alkylene group and $R^{20}$ is an alkyl group.

Examples of the halogen atom represented by $R^{11}$ to $R^{17}$ in General Formula (2) include a fluorine atom, a chlorine atom, a bromine atom, and an iodine atom. Among the above halogen atoms, a fluorine atom and a chlorine atom are preferable, and a chlorine atom is more preferable.

Examples of the alkyl group represented by $R^{11}$ to $R^{17}$ in General Formula (2) include linear and branched alkyl groups having 1 to 20 (preferably 1 to 6, more preferably 1 to 4, further preferably 1 to 3) carbon atoms. Examples of the linear alkyl groups include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group. Examples of the branched alkyl groups include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, and a neoicosyl group. Among the above alkyl groups, in particular, a methyl group and an ethyl group may be used.

Examples of the alkoxy group represented by $R^{11}$ to $R^{17}$ in General Formula (2) include linear and branched alkoxy groups having 1 to 20 (preferably 1 to 6, more preferably 1 to 4, further preferably 1 to 3) carbon atoms. Examples of the linear alkoxy groups include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, an n-nonadecyloxy group, and an n-icosyloxy group. Examples of the branched alkoxy groups include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, and a neoicosyloxy group. Among the above alkoxy groups, in particular, a methoxy group may be used.

Examples of the aryl group represented by $R^{11}$ to $R^{17}$ in General Formula (2) include aryl groups having 6 to 30 (preferably 6 to 20, more preferably 6 to 16) carbon atoms. Specific examples thereof include a phenyl group, a biphenylyl group, a naphthyl group, and a phenanthryl group. Among the above aryl groups, in particular, a phenyl group and a naphthyl group may be used. The above aryl groups may include 1 to 5 (preferably 1 or 2) substituent groups. Examples of the substituent groups include linear and branched alkyl groups having 1 to 4 carbon atoms, such as a methyl group and an ethyl group; linear and branched alkoxy groups having 1 to 4 carbon atoms, such as a methoxy group and an ethoxy group; and halogen atoms, such as a fluorine atom and a chlorine atom.

Examples of the aralkyl group represented by $R^{11}$ to $R^{17}$ in General Formula (2) include linear and branched alkylene groups having 1 to 6 carbon atoms (e.g., a methylene group, an ethylene group, an n-propylene group, an isopropylene group, an n-butylene group, an isobutylene group, a sec-butylene group, a tert-butylene group, a pentylene group, and a hexylene group) to which a phenyl group, a biphenylyl group, a naphthyl group, or the like is attached. Among the above aralkyl groups, in particular, a benzyl group and a phenethyl group may be used. The above aralkyl groups may include 1 to 5 (preferably 1 or 2) substituent groups attached to the benzene ring. Examples of the substituent group include linear and branched alkyl groups having 1 to 4 carbon atoms, such as a methyl group and an ethyl group; linear and branched alkoxy groups having 1 to 4 carbon atoms, such as a methoxy group and an ethoxy group; and halogen atoms, such as a fluorine atom and a chlorine atom.

Examples of the alkyl group represented by $R^{18}$ in General Formula (2) are the same as the above-described examples of the alkyl group represented by $R^{11}$ to $R^{17}$. The alkyl group represented by $R^{18}$ is preferably an alkyl group having 1 to 12 carbon atoms, is more preferably an alkyl group having 4 to 10 carbon atoms, and is further preferably an alkyl group having 5 to 10 carbon atoms.

Examples of the aryl group represented by $R^{18}$ in General Formula (2) are the same as the above-described examples of the aryl group represented by $R^{11}$ to $R^{17}$. The aryl group represented by $R^{18}$ may be an aryl group substituted with an alkyl group, that is, an alkyl-substituted aryl group, in order to enhance solubility in an organic solvent. The aryl group represented by $R^{18}$ may be a phenyl group, a methylphenyl group, a dimethylphenyl group, or an ethylphenyl group.

Examples of the aralkyl group represented by $R^{18}$ in General Formula (2) are the same as the above-described examples of the aralkyl group represented by $R^{11}$ to $R^{17}$. The aralkyl group represented by $R^{18}$ may be an aralkyl group substituted with an alkyl group, that is, an alkyl-substituted aralkyl group, in order to enhance solubility in an organic solvent. The aralkyl group represented by $R^{18}$ may be a benzyl group, a methylbenzyl group, a dimethylbenzyl group, or a phenethyl group.

In the $-L^{19}-O-R^{20}$ group (where $L^{19}$ is an alkylene group and $R^{20}$ is an alkyl group) represented by $R^{18}$ in General Formula (2), examples of the alkylene group represented by $L^{19}$ include linear and branched alkylene groups having 1 to 6 carbon atoms, such as a methylene group, an ethylene group, an n-propylene group, an isopropylene group, an n-butylene group, an isobutylene group, a sec-butylene group, a tert-butylene group, a pentylene group, and a hexylene group, and examples of the alkyl group represented by $R^{20}$ are the same as the above-described examples of the alkyl group represented by $R^{11}$ to $R^{17}$.

In the compound represented by General Formula (2), $R^{11}$ to $R^{17}$ may each independently represent a hydrogen atom, a halogen atom, or an alkyl group, and $R^{18}$ may represent an alkyl group having 4 to 10 carbon atoms in order to increase the sensitivity of the photosensitive layer.

Specific examples of the compound represented by General Formula (2) include, but are not limited to, the following exemplary compounds.

TABLE 5

| Exemplary compound | $R^{11}$ | $R^{12}$ | $R^{13}$ | $R^{14}$ | $R^{15}$ | $R^{16}$ | $R^{17}$ | $R^{18}$ |
|---|---|---|---|---|---|---|---|---|
| 2-1 | H | H | H | H | H | H | H | $-n-C_7H_{15}$ |
| 2-2 | H | H | H | H | H | H | H | $-n-C_8H_{17}$ |
| 2-3 | H | H | H | H | H | H | H | $-n-C_5H_{11}$ |
| 2-4 | H | H | H | H | H | H | H | $-n-C_{10}H_{21}$ |
| 2-5 | Cl | Cl | Cl | Cl | Cl | Cl | Cl | $-n-C_7H_{15}$ |
| 2-6 | H | Cl | H | Cl | H | Cl | Cl | $-n-C_7H_{15}$ |
| 2-7 | $CH_3$ | $CH_3$ | $CH_3$ | $CH_3$ | $CH_3$ | $CH_3$ | $CH_3$ | $-n-C_7H_{15}$ |
| 2-8 | $C_4H_9$ | $C_4H_9$ | $C_4H_9$ | $C_4H_9$ | $C_4H_9$ | $C_4H_9$ | $C_4H_9$ | $-n-C_7H_{15}$ |
| 2-9 | $OCH_3$ | H | $OCH_3$ | H | $OCH_3$ | H | $OCH_3$ | $-n-C_8H_{17}$ |
| 2-10 | $C_6H_5$ | $C_6H_5$ | $C_6H_5$ | $C_6H_5$ | $C_6H_5$ | $C_6H_5$ | $C_6H_5$ | $-n-C_8H_{17}$ |
| 2-11 | H | H | H | H | H | H | H | $-n-C_4H_9$ |
| 2-12 | H | H | H | H | H | H | H | $-n-C_{11}H_{23}$ |
| 2-13 | H | H | H | H | H | H | H | $-n-C_9H_{19}$ |
| 2-14 | H | H | H | H | H | H | H | $—CH_2—CH(C_2H_5)—C_4H_9$ |
| 2-15 | H | H | H | H | H | H | H | $—(CH_2)_2—C_6H_5$ |
| 2-16 | H | H | H | H | H | H | H | $—CH_2—C_6H_5$ |
| 2-17 | H | H | H | H | H | H | H | $-n-C_{12}H_{25}$ |
| 2-18 | H | H | H | H | H | H | H | $—C_2H_4—O—CH_3$ |

Only one compound represented by General Formula (2) may be used alone. Alternatively, two or more compounds represented by General Formula (2) may be used in combination with one another. When the compound represented by General Formula (2) is used, another electron-transporting material may be used in combination with the compound represented by General Formula (2). In the case where another electron-transporting material is used in combination with the compound represented by General Formula (2), the amount of the compound represented by General Formula (2) may be 90% by mass or more of the total amount of the electron-transporting materials.

The amount of electron-transporting material is preferably 5% by mass or more and 20% by mass or less, is more preferably 10% by mass or more and 25% by mass or less, and is further preferably 15% by mass or more and 20% by mass or less of the amount of the photosensitive layer.

Charge-Controlling Agent

Although the electrophotographic photosensitive member used in this exemplary embodiment may be either a positively chargeable electrophotographic photosensitive member or a negatively chargeable electrophotographic photosensitive member, using a positively chargeable electrophotographic photosensitive member may enhance the advantageous effects of the image-forming apparatus according to an exemplary embodiment.

The single-layer photosensitive layer of the positively chargeable electrophotographic photosensitive member preferably includes a charge-controlling agent and more preferably includes an electron-donating charge-controlling agent. Adding an electron-donating charge-controlling agent to the photosensitive layer may facilitate the formation of the positively chargeable photosensitive layer.

The charge-controlling agent may be selected from the compounds known as an agent for controlling electric charge of a toner.

Examples of the electron-donating charge-controlling agent include an azo metal charge-controlling agent, an oxycarboxylic acid charge-controlling agent, a boron complex charge-controlling agent, an iron complex charge-controlling agent, a zinc complex charge-controlling agent, an alkyl salicylic acid complex salt charge-controlling agent, and a sulfonic acid pendant resin charge-controlling agent.

The above charge-controlling agents may be used alone or in combination of two or more.

The amount of the charge-controlling agent, which may be particularly an electron-donating charge-controlling agent, is preferably 0.01 parts by mass or more and 20 parts by mass or less, is more preferably 0.05 parts by mass or more and 10 parts by mass or less, and is further preferably 0.1 parts by mass or more and 5 parts by mass or less relative to 100 parts by mass of the binder resin included in the photosensitive layer.

Other Constituents

The single-layer photosensitive layer may optionally include other known additives, such as a surfactant, an antioxidant, a photostabilizer, and a heat stabilizer. In the case where the single-layer photosensitive layer serves as a surface layer, the single-layer photosensitive layer may include a parting agent, such as fluororesin particles or a silicone polymer.

Method for Forming Single-Layer Photosensitive Layer

The single-layer photosensitive layer may be formed by preparing a coating liquid including the binder resin, the charge-generating material, the electron-transporting material, and the hole-transporting material (hereinafter, this coating liquid is referred to as "photosensitive layer-forming coating liquid"), applying the photosensitive layer-forming coating liquid to the conductive base, and drying the resulting coating film.

The photosensitive layer-forming coating liquid may be, for example, a liquid composition prepared by dissolving or dispersing the binder resin, the charge-generating material, the hole-transporting material, and the electron-transporting material in a solvent.

Examples of the solvent used for preparing the photosensitive layer-forming composition include the following organic solvents: aromatic hydrocarbons, such as benzene, toluene, xylene, and chlorobenzene; ketones, such as acetone and 2-butanone; halogenated aliphatic hydrocarbons, such as methylene chloride, chloroform, and ethylene chloride; and cyclic and linear ethers, such as tetrahydrofuran and ethyl ether. The above solvents may be used alone or in a mixture of two or more.

For dispersing particles of the charge-generating material or the like in the photosensitive layer-forming composition, for example, the following dispersers may be used: media dispersers, such as a ball mill, a vibrating ball mill, an Attritor, a sand mill, and a horizontal sand mill; and media-less dispersers, such as a stirrer, an ultrasonic disperser, a roll mill, and a high-pressure homogenizer. Examples of the high-pressure homogenizer include an impact-type homogenizer in which a dispersion is brought into collision with a liquid or a wall under a high-pressure condition in order to perform dispersion and a pass-through-type homogenizer in which a dispersion is passed through a very thin channel under a high-pressure condition in order to perform dispersion.

For applying the photosensitive layer-forming composition to the conductive base, for example, blade coating, wire bar coating, spray coating, dip coating, bead coating, air knife coating, and curtain coating may be used.

The photosensitive layer-forming composition deposited on the conductive base is dried to form a photosensitive layer on the conductive base. For drying the photosensitive layer-forming composition, a heat treatment may be performed, for example, at 120° C. to 150° C. for 10 to 60 minutes.

The thickness of the single-layer photosensitive layer is preferably 5 μm or more and 60 μm or less, is more preferably 10 μm or more and 50 μm or less, and is further preferably 20 μm or more and 40 μm or less.

Undercoat Layer

An undercoat layer may be interposed between the conductive base and the photosensitive layer. The undercoat layer includes, for example, inorganic particles and a binder resin.

The inorganic particles have, for example, a powder resistivity (i.e., a volume resistivity) of $1\times10^{2}$ Ωcm or more and $1\times10^{11}$ Ωcm or less. Among such inorganic particles having the above resistivity, for example, metal oxide particles such as tin oxide particles, titanium oxide particles, zinc oxide particles, and zirconium oxide particles are preferable, and zinc oxide particles are particularly preferable.

The BET specific surface area of the inorganic particles may be, for example, 10 $m^2/g$ or more.

The volume-average diameter of the inorganic particles is preferably, for example, 50 nm or more and 2,000 nm or less and is more preferably 60 nm or more and 1,000 nm or less.

The amount of the inorganic particles is preferably, for example, 10% by mass or more and 80% by mass or less and is more preferably 40% by mass or more and 80% by mass or less of the amount of binder resin.

The inorganic particles may optionally be subjected to a surface treatment. It is possible to use two or more types of inorganic particles which have been subjected to different surface treatments or have different sizes in a mixture.

Examples of an agent used for the surface treatment include a silane coupling agent, a titanate coupling agent, an aluminum coupling agent, and a surfactant. In particular, a silane coupling agent is preferable, and a silane coupling agent including an amino group is more preferable.

Examples of the silane coupling agent including an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in a mixture. For example, a silane coupling agent including an amino group may be used in combination with another type of silane coupling agent. Examples of the other type of silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

A method for treating the surfaces of the inorganic particles with the surface-treating agent is not limited, and any known surface treatment method may be used. Both dry process and wet process may be used.

The amount of surface-treating agent used may be, for example, 0.5% by mass or more and 10% by mass or less of the amount of inorganic particles.

The undercoat layer may include an electron-accepting compound (i.e., an acceptor compound) in addition to the inorganic particles in order to enhance the long-term stability of electrical properties and carrier-blocking property.

Examples of the electron-accepting compound include the following electron-transporting substances: quinones, such as chloranil and bromanil; tetracyanoquinodimethanes; fluorenones, such as 2,4,7-trinitrofluorenone and 2,4,5,7-tetranitro-9-fluorenone; oxadiazoles, such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthones; thiophenes; and diphenoquinones, such as 3,3',5,5'-tetra-t-butyldiphenoquinone. In particular, compounds including an anthraquinone structure may be used as an electron-accepting compound. Examples of the compounds including an anthraquinone structure include hydroxyanthraquinones, aminoanthraquinones, and aminohydroxyanthraquinones. Specific examples thereof include anthraquinone, alizarin, quinizarin, anthrarufin, and purpurin.

The electron-accepting compound included in the undercoat layer may be dispersed in the undercoat layer together with the inorganic particles or deposited on the surfaces of the inorganic particles.

For depositing the electron-accepting compound on the surfaces of the inorganic particles, for example, a dry process or a wet process may be used.

In a dry process, for example, while the inorganic particles are stirred with a mixer or the like capable of producing a large shearing force, the electron-accepting compound or a solution prepared by dissolving the electron-accepting compound in an organic solvent is added dropwise or sprayed together with dry air or a nitrogen gas to the inorganic particles in order to deposit the electron-accepting compound on the surfaces of the inorganic particles. The addition or spraying of the electron-accepting compound may be done at a temperature equal to or lower than the boiling point of the solvent used. Subsequent to the addition or spraying of the electron-accepting compound, the resulting inorganic particles may optionally be baked at 100° C. or more. The temperature at which the inorganic particles are baked and the amount of time during which the inorganic particles are baked are not limited; the baking temperature and the amount of baking time may be set appropriately such that the intended electrophotographic properties are achieved.

In the wet process, for example, while the inorganic particles are dispersed in a solvent with a stirrer, an ultrasonic wave, a sand mill, an Attritor, a ball mill, or the like, the electron-accepting compound is added to the dispersion liquid. After the resulting mixture has been stirred or dispersed, the solvent is removed such that the electron-accepting compound is deposited on the surfaces of the inorganic particles. The removal of the solvent may be done by, for example, filtration or distillation. Subsequent to the removal of the solvent, the resulting inorganic particles may optionally be baked at 100° C. or more. The baking temperature and the amount of baking time are not limited and may be set appropriately such that the intended electrophotographic properties are achieved. In the wet process, moisture contained in the inorganic particles may be removed prior to the addition of the electron-accepting compound. The removal of moisture contained in the inorganic particles may be done by, for example, heating the inorganic particles while being stirred in the solvent or by bringing the moisture to the boil together with the solvent.

The deposition of the electron-accepting compound may be done either prior or subsequent to the surface treatment of the inorganic particles with the surface-treating agent. Alternatively, the deposition of the electron-accepting compound and the surface treatment using the surface-treating agent may be performed at the same time.

The content of the electron-accepting compound is preferably, for example, 0.01% by mass or more and 20% by mass or less and is more preferably 0.01% by mass or more and 10% by mass or less of the amount of inorganic particles.

Examples of the binder resin included in the undercoat layer include the following known materials: known high-molecular compounds such as an acetal resin (e.g., polyvinyl butyral), a polyvinyl alcohol resin, a polyvinyl acetal resin, a casein resin, a polyamide resin, a cellulose resin, gelatin, a polyurethane resin, a polyester resin, an unsaturated polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a urea resin, a phenolic resin, a phenol-formaldehyde resin, a melamine resin, a urethane resin, an alkyd resin, and an epoxy resin; zirconium chelates; titanium chelates; aluminum chelates; titanium alkoxides; organic titanium compounds; and silane coupling agents.

Examples of the binder resin included in the undercoat layer further include charge-transporting resins including a charge-transporting group; and conductive resins, such as polyaniline.

Among the above binder resins, a resin insoluble in a solvent included in a coating liquid used for forming a layer on the undercoat layer may be used as a binder resin included in the undercoat layer. In particular, resins produced by reacting at least one resin selected from the group consisting of thermosetting resins (e.g., a urea resin, a phenolic resin, a phenol-formaldehyde resin, a melamine resin, a urethane resin, an unsaturated polyester resin, an alkyd resin, and an epoxy resin), polyamide resins, polyester resins, polyether resins, methacrylic resins, acrylic resins, polyvinyl alcohol resins, and polyvinyl acetal resins with a curing agent may be used.

In the case where two or more types of the above binder resins are used in combination, the mixing ratio between the binder resins may be set appropriately.

The undercoat layer may include various additives in order to enhance electrical properties, environmental stability, and image quality.

Examples of the additives include the following known materials: electron-transporting pigments, such as polycondensed pigments and azo pigments, zirconium chelates, titanium chelates, aluminum chelates, titanium alkoxides, organic titanium compounds, and silane coupling agents. A silane coupling agent, which is used in the surface treatment of the inorganic particles as described above, may be added to the undercoat layer as an additive.

Examples of the silane coupling agent used as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelates include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelates include tetraisopropyl titanate, tetra-n-butyl titanate, butyl titanate dimer, tetra-(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolamine, and polyhydroxy titanium stearate.

Examples of the aluminum chelates include aluminum isopropylate, monobutoxy aluminum diisopropylate, aluminum butyrate, diethyl acetoacetate aluminum diisopropylate, and aluminum tris(ethyl acetoacetate).

The above additives may be used alone. Alternatively, two or more types of the above additives may be used in a mixture or in the form of a polycondensate.

The undercoat layer may have a Vickers hardness of 35 or more.

In order to reduce the formation of moiré fringes, the surface roughness (i.e., ten-point-average roughness) of the undercoat layer may be adjusted to 1/(4n) to ½ of the wavelength λ of the laser beam used as exposure light, where n is the refractive index of the layer that is to be formed on the undercoat layer.

Resin particles and the like may be added to the undercoat layer in order to adjust the surface roughness of the undercoat layer. Examples of the resin particles include silicone resin particles and crosslinked polymethyl methacrylate resin particles. The surface of the undercoat layer may be ground in order to adjust the surface roughness of the undercoat layer. For grinding the surface of the undercoat layer, buffing, sand blasting, wet honing, cutting, and the like may be performed.

The method for forming the undercoat layer is not limited, and known methods may be used. The undercoat layer may be formed by, for example, forming a coating film using a coating liquid prepared by mixing the above-described constituents with a solvent (hereinafter, this coating liquid is referred to as "undercoat layer-forming coating liquid"), drying the coating film, and, as needed, heating the coating film.

Examples of the solvent used for preparing the undercoat layer-forming coating liquid include known organic solvents, such as an alcohol solvent, an aromatic hydrocarbon solvent, a halogenated hydrocarbon solvent, a ketone solvent, a ketone alcohol solvent, an ether solvent, and an ester solvent.

Specific examples thereof include the following common organic solvents: methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

For dispersing the inorganic particles in the preparation of the undercoat layer-forming coating liquid, for example, known equipment such as a roll mill, a ball mill, a vibrating ball mill, an Attritor, a sand mill, a colloid mill, and a paint shaker may be used.

For coating the conductive base with the undercoat layer-forming coating liquid, for example, common methods such as blade coating, wire bar coating, spray coating, dip coating, bead coating, air knife coating, and curtain coating may be used.

The thickness of the undercoat layer is preferably, for example, 15 μm or more and is more preferably 20 μm or more and 50 μm or less.

Intermediate Layer

An intermediate layer may optionally be interposed between the undercoat layer and the photosensitive layer.

The intermediate layer includes, for example, a resin. Examples of the resin included in the intermediate layer include the following high-molecular compounds: acetal resins (e.g., polyvinyl butyral), polyvinyl alcohol resins, polyvinyl acetal resins, casein resins, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may include an organometallic compound. Examples of the organometallic compound included in the intermediate layer include organometallic compounds containing a metal atom such as a zirconium atom, a titanium atom, an aluminum atom, a manganese atom, or a silicon atom.

The above compounds included in the intermediate layer may be used alone. Alternatively, two or more types of the above compounds may be used in a mixture or in the form of a polycondensate.

In particular, the intermediate layer may include an organometallic compound containing a zirconium atom or a silicon atom.

The method for forming the intermediate layer is not limited, and known methods may be used. The intermediate layer may be formed by, for example, forming a coating film using a coating liquid (i.e., an intermediate layer-forming coating liquid) prepared by mixing the above-described constituents with a solvent, drying the coating film and, as needed, heating the coating film.

For forming the intermediate layer, common coating methods such as dip coating, push coating, wire bar coating, spray coating, blade coating, knife coating, and curtain coating may be used.

The thickness of the intermediate layer may be, for example, 0.1 μm or more and 3 μm or less. It is possible to use the intermediate layer also as an undercoat layer.

Protection Layer

A protection layer may optionally be disposed on the photosensitive layer. The protection layer is provided in order to, for example, reduce the chemical change of the photosensitive layer which may occur during charging and increase the mechanical strength of the photosensitive layer.

Therefore, the protection layer may be a layer composed of a cured film (i.e., a crosslinked film). Examples of such a layer include the layers described in 1) and 2) below.

1) A layer composed of a film formed by curing a composition including a reactive group-containing charge-transporting material that includes a reactive group and a charge-transporting skeleton in the same molecule, that is, a layer including a polymer or a crosslinked product of the reactive group-containing charge-transporting material.

2) A layer composed of a film formed by curing a composition including a nonreactive charge-transporting material and a reactive group-containing non-charge-transporting material that does not include a charge-transporting skeleton and includes a reactive group, that is, a layer including a polymer or a crosslinked product of the nonreactive charge-transporting material with the reactive group-containing non-charge-transporting material.

Examples of the reactive group included in the reactive group-containing charge-transporting material include the following known reactive groups: a chain-polymerization group; an epoxy group; a —OH group; a —OR group, where R is an alkyl group; a $—NH_2$ group; a —SH group; a —COOH group; and a $—SiR^{Q1}{}_{3-Qn}(OR^{Q2})_{Qn}$ group, where $R^{Q1}$ represents a hydrogen atom, an alkyl group, or an unsubstituted or substituted aryl group, $R^{Q2}$ represents a hydrogen atom, an alkyl group, or a trialkylsilyl group, and Qn is an integer of 1 to 3.

The chain-polymerization group is not limited, and may be any functional group capable of inducing radical polymerization. Examples of the chain-polymerization group include functional groups including at least a carbon double bond. Specific examples of the chain-polymerization group include functional groups including at least one selected from a vinyl group, a vinyl ether group, a vinylthioether group, a styryl group (i.e., a vinylphenyl group), an acryloyl group, a methacryloyl group, and derivatives of the above groups. In particular, a chain-polymerization group including at least one selected from a vinyl group, a styryl group, an acryloyl group, a methacryloyl group, and derivatives of the above groups may be used, because such a chain-polymerization group has high reactivity.

The charge-transporting skeleton of the reactive group-containing charge-transporting material is not limited and may be any charge-transporting skeleton having a structure known in the field of photosensitive members. Examples of such a charge-transporting skeleton include skeletons that are derived from nitrogen-containing hole transporting compounds such as triarylamines, benzidines, and hydrazones and conjugated with a nitrogen atom. Among the above skeletons, in particular, a triarylamine skeleton may be used.

The above-described reactive group-containing charge-transporting material that includes a reactive group and the charge-transporting skeleton, the nonreactive charge-transporting material, and the reactive group-containing non-charge-transporting material may be selected from known materials.

The protection layer may optionally include other known additives.

The method for forming the protection layer is not limited, and known methods may be used. For example, the protection layer may be formed by forming a coating film using a coating liquid prepared by mixing the above-described constituents in a solvent (hereinafter, this coating liquid is referred to as "protection layer-forming coating liquid"), drying the coating film, and, as needed, causing the coating film by heating or the like.

Examples of the solvent used for preparing the protection layer-forming coating liquid include aromatic solvents, such as toluene and xylene; ketone solvents, such as methyl ethyl ketone, methyl isobutyl ketone, and cyclohexanone; ester solvents, such as ethyl acetate and butyl acetate; ether solvents, such as tetrahydrofuran and dioxane; cellosolve solvents, such as ethylene glycol monomethyl ether; and alcohol solvents, such as isopropyl alcohol and butanol. The above solvents may be used alone or in a mixture of two or more. The protection layer-forming coating liquid may be prepared without using a solvent.

For applying the protection layer-forming coating liquid on the photosensitive layer, for example, the following common methods may be used: dip coating, push coating, wire bar coating, spray coating, blade coating, knife coating, and curtain coating.

The thickness of the protection layer is preferably, for example, 1 μm or more and 20 μm or less and is more preferably 2 μm or more and 10 μm or less.

The image-forming apparatus according to an exemplary embodiment may further include a charging unit that charges the surface of the electrophotographic photosensitive member; an electrostatic latent image-forming unit that forms an electrostatic latent image on the charged surface of the electrophotographic photosensitive member; and a transfer unit that transfers the toner image onto the surface of a recording medium.

The image-forming apparatus according to an exemplary embodiment may be implemented as any of the following known image-forming apparatuses: an image-forming apparatus that includes a fixing unit that fixes the toner image transferred on the surface of the recording medium; a direct-transfer image-forming apparatus that directly transfers the toner image formed on the surface of the photosensitive member onto the surface of a recording medium; an intermediate-transfer image-forming apparatus that transfers the toner image formed on the surface of the photosensitive member onto the surface of an intermediate transfer body (this process is referred to as "first transfer") and further transfers the toner image transferred on the surface of the intermediate transfer body onto the surface of a recording medium (this process is referred to as "second transfer"); an image-forming apparatus that includes a cleaning unit that cleans the surface of the photosensitive member after the toner image has been transferred and before the photosensitive member is charged; an image-forming apparatus that includes a charge-eliminating unit that irradiates, with charge-elimination light, the surface of a photosensitive member after the toner image has been transferred and before the photosensitive member is charged in order to eliminate charge; and an image-forming apparatus that includes a photosensitive member-heating member that heats the photosensitive member in order to lower the relative temperature.

In particular, the image-forming apparatus according to an exemplary embodiment may be an image-forming apparatus capable of performing cleaning during development in order to reduce the occurrence of dot-like defects in images formed using the image-forming apparatus. Specifically, the image-forming apparatus according to an exemplary embodiment may be an image-forming apparatus that does not include a cleaning unit other than the developing roller which cleans the surface of the photosensitive member before the photosensitive member is charged.

In the intermediate-transfer image-forming apparatus, the transfer unit includes, for example, an intermediate transfer body onto which a toner image is transferred, a first transfer unit that transfers a toner image formed on the surface of the photosensitive member onto the surface of the intermediate transfer body (first transfer), and a second transfer unit that transfers the toner image transferred on the surface of the intermediate transfer body onto the surface of a recording medium (second transfer).

The image-forming apparatus according to an exemplary embodiment may be either a dry-developing image-forming apparatus or a wet-developing image-forming apparatus in which a liquid developer is used for developing images.

In the image-forming apparatus according to an exemplary embodiment, for example, a portion including the photosensitive member may have a cartridge structure, that is, may be a process cartridge, which is detachably attachable to the image-forming apparatus. The process cartridge may include, for example, the photosensitive member and the developing unit according to the above-described exemplary embodiment. The process cartridge may further include, for example, at least one component selected from the group consisting of the charging unit, the electrostatic latent image-forming unit, and the transfer unit.

An example of the image-forming apparatus according to an exemplary embodiment is described below. However, the image-forming apparatus is not limited to this. Hereinafter, only the components illustrated in the drawings are described, and the descriptions of the other components are omitted.

FIG. 1 schematically illustrates an example of the image-forming apparatus according to an exemplary embodiment.

As illustrated in FIG. 1, an image-forming apparatus 100 according to the above-described exemplary embodiment includes a process cartridge 300 including a photosensitive member 7, an exposure device 9 (an example of the electrostatic latent image-forming unit), a transfer device 40 (i.e., a first transfer device), and an intermediate transfer body 50. In the image-forming apparatus 100, the exposure device 9 is arranged such that the photosensitive member 7 is exposed to light emitted by the exposure device 9 through an aperture formed in the process cartridge 300; the transfer device 40 is arranged to face the photosensitive member 7 across the intermediate transfer body 50; and the intermediate transfer body 50 is arranged such that a part of the intermediate transfer body 50 comes into contact with the photosensitive member 7. Although not illustrated in FIG. 1, the image-forming apparatus 100 also includes a second transfer device that transfers a toner image transferred on the intermediate transfer body 50 onto a recording medium, such as paper. In the image-forming apparatus 100, the intermediate transfer body 50, the transfer device 40 (i.e., a first transfer device), and the second transfer device (not illustrated) correspond to an example of the transfer unit.

The process cartridge 300 illustrated in FIG. 1 includes the photosensitive member 7, a charging device 8 (an example of the charging unit), a developing device 11 (an example of the developing unit), and a cleaning device 13 (an example of the cleaning unit), which are integrally supported inside a housing. The cleaning device 13 includes a cleaning blade 131 (an example of the cleaning member), which is arranged to come into contact with the surface of the photosensitive member 7. The cleaning member is not limited to the cleaning blade 131 and may be a conductive or insulative fibrous member. The conductive or insulative fibrous member may be used alone or in combination with the cleaning blade 131.

The image-forming apparatus 100 according to an exemplary embodiment does not necessarily include the cleaning device 13.

The image-forming apparatus illustrated in FIG. 1 includes a roller-like, fibrous member 132 with which a lubricant 14 is fed onto the surface of the photosensitive member 7 and a flat-brush-like, fibrous member 133 that assists cleaning. However, the image-forming apparatus illustrated in FIG. 1 is merely an example, and the fibrous members 132 and 133 are optional.

Each of the components of the image-forming apparatus according to an exemplary embodiment is described below.

Charging Device

Examples of the charging device 8 include contact chargers that include a charging roller, a charging brush, a charging film, a charging rubber blade, or a charging tube that are conductive or semiconductive; contactless roller chargers; and known chargers such as a scorotron charger and a corotron charger that use corona discharge.

Exposure Device

The exposure device 9 may be, for example, an optical device with which the surface of the photosensitive member 7 can be exposed to light emitted by a semiconductor laser, an LED, a liquid-crystal shutter, or the like in a predetermined image pattern. The wavelength of the light source is set to fall within the range of the spectral sensitivity of the photosensitive member. Although common semiconductor lasers have an oscillation wavelength in the vicinity of 780 nm, that is, the near-infrared region, the wavelength of the light source is not limited to this; lasers having an oscillation wavelength of about 600 to 700 nm and blue lasers having an oscillation wavelength of 400 nm or more and 450 nm or less may also be used. For forming color images, surface-emitting lasers capable of emitting multi beam may be used as a light source.

Developing Device

The developing device 11 may be, for example, a common developing device that develops latent images with a developer in a contacting or noncontacting manner. The developing device 11 is not limited and may be selected from those having the above functions in accordance with the purpose. Examples of the developing device include known developing devices capable of depositing a one- or two-component developer on the photosensitive member 7 with a brush, a roller, or the like. In particular, a developing device including a developing roller on which a developer is deposited may be used.

The developer included in the developing device 11 may be either a one-component developer including only a toner or a two-component developer including a toner and a carrier. The developer may be magnetic or nonmagnetic. Known developers may be used as a developer included in the developing device 11.

Cleaning Device

The cleaning device 13 is a cleaning-blade-type cleaning device including a cleaning blade 131. The cleaning device 13 is not limited to the cleaning-blade-type cleaning device and may be a fur-brush-cleaning-type cleaning device or a cleaning device that performs cleaning during development. In particular, a cleaning device that performs cleaning during development may be used.

Transfer Device

Examples of the transfer device 40 include the following known transfer chargers: contact transfer chargers including a belt, a roller, a film, a rubber blade, or the like; and transfer chargers which use corona discharge, such as a scorotron transfer charger and a corotron transfer charger.

Intermediate Transfer Body

The intermediate transfer body 50 is a belt-like intermediate transfer body, that is, an intermediate transfer belt, including polyimide, polyamideimide, polycarbonate, polyarylate, polyester, a rubber, or the like that is made semiconductive. The intermediate transfer body is not limited to a belt-like intermediate transfer body and may be a drum-like intermediate transfer body.

Figure 2:
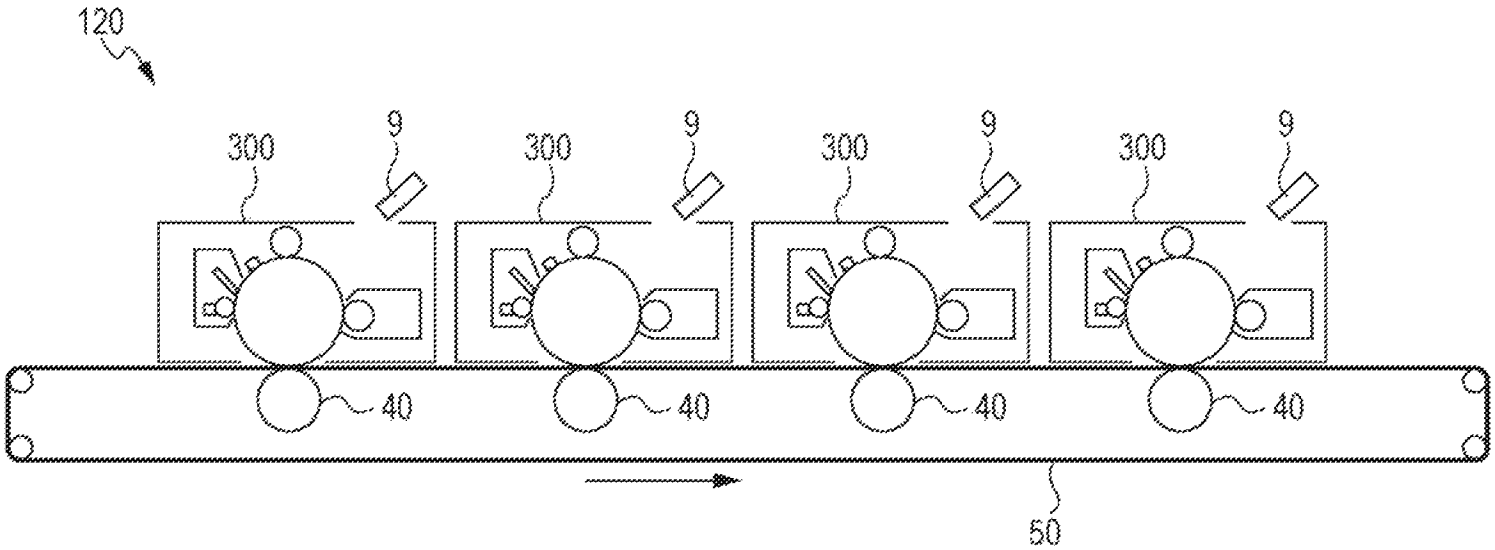
FIG. 2 is a schematic diagram illustrating another example of the structure of an image-forming apparatus according to an exemplary embodiment.

FIG. 2 schematically illustrates another example of the image-forming apparatus according to an exemplary embodiment.

The image-forming apparatus 120 illustrated in FIG. 2 is a tandem, multi-color image-forming apparatus including four process cartridges 300. In the image-forming apparatus 120, the four process cartridges 300 are arranged in parallel to one another on an intermediate transfer body 50, and one photosensitive member is used for one color. The image-forming apparatus 120 has the same structure as the image-forming apparatus 100 except that the image-forming apparatus 120 is tandem.

Image-Forming Method

An image-forming method according to an exemplary embodiment includes, using an image-forming apparatus including an electrophotographic photosensitive member including a conductive base and a single-layer photosensitive layer disposed on the conductive base, the single-layer photosensitive layer including a binder resin, a charge-generating material, a hole-transporting material, and an electron-transporting material, and a developing unit including a developing roller that develops an electrostatic latent image formed on the surface of the electrophotographic photosensitive member with a developer including a toner in order to form a toner image, the developing roller being arranged to come into contact with the photosensitive layer, developing the electrostatic latent image formed on the surface of the electrophotographic photosensitive member with the developer including the toner in order to form the toner image, wherein the ratio R/P of the content R [mass %] of the binder resin in the photosensitive layer to the pressing force P [N/mm] at which the developing roller is pressed against the photosensitive layer is 11.5 or more and 19.6 or less or about 11.5 or more and about 19.6 or less.

The image-forming apparatus used in the image-forming method according to an exemplary embodiment may be the image-forming apparatus according to the above-described exemplary embodiment. The electrophotographic photosensitive member and the developing roller used in the image-forming method according to an exemplary embodiment are the same as those included in the image-forming apparatus according to the above-described exemplary embodiment.

The image-forming method according to an exemplary embodiment may further include charging the surface of the electrophotographic photosensitive member; forming an electrostatic latent image on the charged surface of the electrophotographic photosensitive member; and transferring the toner image onto the surface of a recording medium.

The steps other than the developing step in which the ratio R/P of the content R [mass %] of the binder resin in the photosensitive layer in terms of solid content to the pressing force P [N/mm] at which the developing roller is pressed against the photosensitive layer is 11.5 or more and 19.6 or less or about 11.5 or more and about 19.6 or less are common steps described in, for example, Japanese Unexamined Patent Application Publication No. 56-40868 and Japanese Unexamined Patent Application Publication No. 49-91231. The image-forming method according to an exemplary embodiment may be implemented using a known image-forming apparatus, such as a copier or a facsimile.

The charging step is a step in which the image-holding member (i.e., the photosensitive member) is charged.

The exposure step is a step in which an electrostatic latent image is formed on the surface of the image-holding member by exposure.

The transfer step is a step in which the toner image is transferred to a member to which a toner image is to be transferred. Examples of the member to which a toner image is to be transferred in the transfer step include an intermediate transfer body and a recording medium, such as paper.

In the fixing step, for example, the toner image transferred on transfer paper may be fixed using a hot-roller fuser that includes a hot roller having a constant temperature to form a copied image.

The image-forming method according to the exemplary embodiment may, but preferably does not, include a cleaning step in which a part of the electrostatic image developer which remains on the image-holding member is removed with a cleaning unit, such as a cleaning blade.

In other words, in the image-forming method according to an exemplary embodiment, it is preferable to perform cleaning during development in order to enhance the advantageous effects of the image-forming method according to an exemplary embodiment.

Examples of the recording medium include known recording media, such as paper sheets and OHP sheets that may be used in electrophotographic copiers, printers, and the like. In particular, coated paper sheets produced by coating the surfaces of plain paper sheets with a resin or the like, printing art paper sheets, and the like may be used.

The image-forming method according to an exemplary embodiment may further include a recycle step, in which toner particles recovered using the developing roller in the developing step are reused as a developer. The above image-forming method including the recycle step is implemented using an image-forming apparatus, such as a copier or a facsimile, which includes a toner recycle system. The above image-forming method may also be applied to an image-forming apparatus having a toner recycle system in which the cleaning step is omitted and the recovery of toner is performed during development.

EXAMPLES

The exemplary embodiments of the invention are described further specifically with reference to Examples and Comparative examples below. The exemplary embodiments of the invention are not limited by Examples below.

Preparation of Photosensitive Layer-Forming Coating Liquid Used for Forming Photosensitive Members 1 and 2

A mixture of 45 parts by mass of a bisphenol Z polycarbonate resin (viscosity-average molecular weight: 50,000), 1.0 parts by mass of the charge-generating material CGM1 illustrated below, 40 parts by mass of the hole-transporting material HTM1 illustrated below, 14 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 3, 4, 17, and 18

A mixture of 50 parts by mass of a bisphenol Z polycarbonate resin (viscosity-average molecular weight: 50,000), 1.0 parts by mass of the charge-generating materials CGM1 and CGM2 illustrated below (mass ratio=5:5), 36 parts by mass of the hole-transporting material HTM2 illustrated below, 13 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 5 and 9

A mixture of 55 parts by mass of a polycarbonate resin (viscosity-average molecular weight: 50,000), 1.0 parts by mass of the charge-generating materials CGM1 and CGM2 illustrated below (mass ratio=5:5), 24 parts by mass of the hole-transporting material HTM1 illustrated below, 12 parts by mass of the hole-transporting material HTM2 illustrated below, 8 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Member 6

A mixture of 55 parts by mass of a polyester resin (viscosity-average molecular weight: 50,000), 1.0 parts by mass of the charge-generating materials CGM1 and CGM2 illustrated below (mass ratio=5:5), 24 parts by mass of the hole-transporting material HTM1 illustrated below, 12 parts by mass of the hole-transporting material HTM2 illustrated below, 8 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Member 7

A mixture of 55 parts by mass of a polyarylate resin (viscosity-average molecular weight: 50,000), 1.0 parts by mass of the charge-generating materials CGM1 and CGM2 illustrated below (mass ratio=5:5), 24 parts by mass of the hole-transporting material HTM1 illustrated below, 12 parts by mass of the hole-transporting material HTM2 illustrated below, 8 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 8 and 10

A mixture of 55 parts by mass of a bisphenol Z polycarbonate resin (viscosity-average molecular weight: 50,000), 1.0 parts by mass of the charge-generating materials CGM1 and CGM2 illustrated below (mass ratio=5:5), 24 parts by mass of the hole-transporting material HTM1 illustrated below, 12 parts by mass of the hole-transporting material HTM2 illustrated below, 8 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 11 and 12

A mixture of 60 parts by mass of a bisphenol Z polycarbonate resin (viscosity-average molecular weight: 50,000), 1.0 parts by mass of the charge-generating materials CGM1 and CGM2 illustrated below (mass ratio=5:5), 29 parts by mass of the hole-transporting material HTM2 illustrated below, 10 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 13 and 14

A mixture of 65 parts by mass of a bisphenol Z polycarbonate resin (viscosity-average molecular weight: 50,000), 1.0 parts by mass of the charge-generating materials CGM1 and CGM2 illustrated below (mass ratio=5:5), 27 parts by mass of the hole-transporting material HTM2 illustrated below, 7 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members 15 and 16

A mixture of 70 parts by mass of a bisphenol Z polycarbonate resin (viscosity-average molecular weight: 50,000), 1.0 parts by mass of the charge-generating materials CGM1 and CGM2 illustrated below (mass ratio=5:5), 24 parts by mass of the hole-transporting material HTM2 illustrated below, 5 parts by mass of the electron-transporting material ETM1 illustrated below, and 400 parts by mass of tetrahydrofuran is dispersed with a high-pressure homogenizer to form a photosensitive layer-forming coating liquid.

Preparation of Photosensitive Layer-Forming Coating Liquid Used for Forming Photosensitive Members C1 and C2

A mixture of 40 parts by mass of a bisphenol Z polycarbonate resin (viscosity-average molecular weight: 50,000), 1.0 parts by mass of the charge-generating materials CGM1 and CGM2 illustrated below (mass ratio=5:5), 43 parts by mass of the hole-transporting material HTM2 illustrated below, 16 parts by mass of the electron-transporting material ETM1 illustrated below, and 400 parts by mass of tetrahydrofuran is dispersed with a high-pressure homogenizer to form a photosensitive layer-forming coating liquid.

CGM1

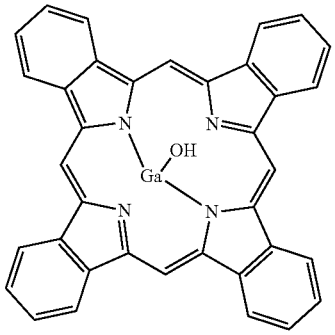

CGM2

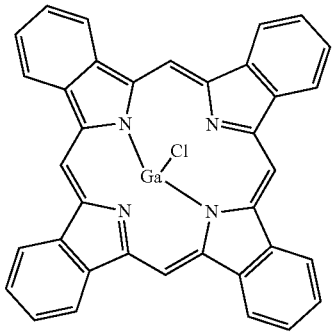

ETM1

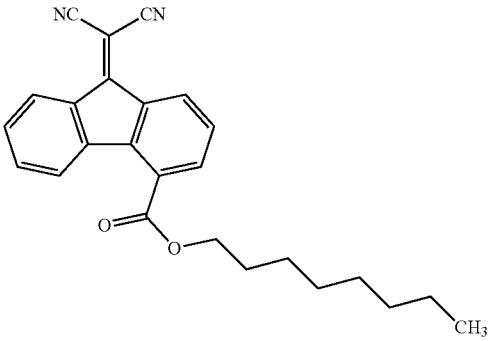

-continued

HTM1

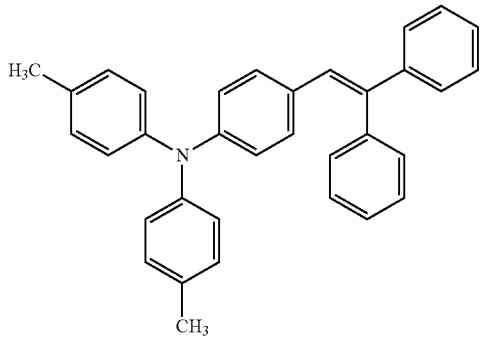

HTM2

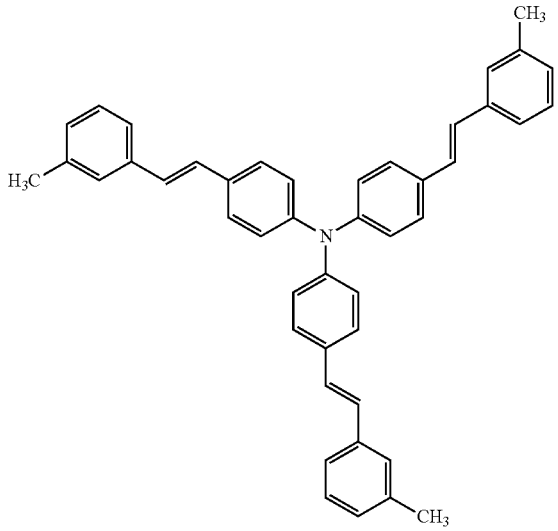

Preparation of Photosensitive Members 1 to 18, C1, and C2

As a conductive base, an aluminum base having a diameter of 30 mm, a length of 244.5 mm, and a thickness of 1 mm is prepared. The specific one of the photosensitive layer-forming coating liquids is applied to the aluminum base by dip coating, and the resulting coating film is dried at 135° C. for 35 minutes so as to be cured. Hereby, a single-layer photosensitive layer having a thickness of 22 μm is formed on the aluminum base. Photosensitive members 1 to 18, C1, and C2 are prepared in the above-described manner.

Examples 1 to 18 and Comparative Examples 1 to 16 Image-Forming Apparatus

To HL-2360DN produced by Brother Industries, Ltd., the specific one of the photosensitive members described in Table 6 and a rubber roller including a conductive rubber prepared by mixing a conductive compound, such as a carbon, with a urethane rubber, a silicone rubber, a nitrile rubber (NBR), or the like, the rubber roller serving as a developing roller, are attached in order to prepare an image-forming apparatus. The pressing force at which the developing roller is pressed against the photosensitive member, that is, the pressing force at which the developing roller is pressed by a spring, is adjusted to the corresponding one of the pressing forces described in Table 6.

Evaluations

Evaluation of Abrasion Loss of Photosensitive Member (Abrasion Test)

An image (i.e., characters) is formed on 15,000 sheets at a coverage rate of 4% with the image-forming apparatus HL-2360DN produced by Brother Industries, Ltd. The abrasion loss of the photosensitive member is determined from the difference between the thickness of the photosensitive member measured after the 15,000-sheet printing and the thickness of the photosensitive member measured at the initial state, that is, before the 15,000-sheet printing.

Criteria for Evaluation of Abrasion Loss

A: Change in thickness during the 15,000-sheet printing is less than 1.5 μm

B: Change in thickness during the 15,000-sheet printing is 1.5 μm or more

Evaluation of Image Quality (Dot-Like Defects)

A blank white image is formed on 1,000 sheets at a temperature of 33° C. and a humidity of 80% with the image-forming apparatus HL-2360DN produced by Brother Industries, Ltd. from which the developing roller has been removed, that is, without the developing device, in order to cause paper dust particles to adhere on the surface of the photosensitive member.

The developing device is attached to the photosensitive unit used for the 1,000-sheet printing such that the developing roller is pressed against the photosensitive member, that is, the developing roller is pressed by a spring, at the corresponding one of the pressing forces described in Table 6. Subsequently, a blank white image is formed on 3,000 sheets.

Subsequent to the 3,000-sheet printing, a solid white image is formed. The number of minute black spots (i.e., dot-like defects) occurring in the image with a photosensitive-member pitch is counted.

The dot-like defects in the image are evaluated in accordance with the following criteria.

Criteria for Evaluation of Dot-Like Defects

5: Excellent (the occurrence of dot-like defects is negligible and acceptable)

4: Good (a few dot-like defects are present, but within an acceptable range)

3: Fair (dot-like defects are present within a potentially unacceptable range)

2: Poor (dot-like defects are present within an unacceptable range)

1: Bad (a number of dot-like defects are present within an unacceptable range)

Table 6 summarizes the evaluation results.

TABLE 6

| | Type of photosensitive member | Content of binder resin in photosensitive layer, R: Type of binder resin | Content R (mass %) | Type of rubber included in developing roller | Pressing force of developing roller, P (mN/m) | R/P | Abrasion Test | Dot-like defects |
|---|---|---|---|---|---|---|---|---|
| Example 1 | 1 | Bisphenol Z polycarbonate resin | 45.0 | Urethane rubber | 3.9 | 11.5 | A | 5 |
| Example 2 | 2 | Bisphenol Z polycarbonate resin | 45.0 | Urethane rubber | 2.3 | 19.6 | A | 4 |

TABLE 6-continued

| | Type of photosensitive member | Content of binder resin in photosensitive layer, R: Type of binder resin | Content R (mass %) | Type of rubber included in developing roller | Pressing force of developing roller, P (mN/m) | R/P | Abrasion Test | Dot-like defects |
|---|---|---|---|---|---|---|---|---|
| Example 3 | 3 | Bisphenol Z polycarbonate resin | 50.0 | Urethane rubber | 4.2 | 11.9 | A | 5 |
| Example 4 | 4 | Bisphenol Z polycarbonate resin | 50.0 | Urethane rubber | 2.6 | 19.2 | A | 4 |
| Example 5 | 5 | Polycarbonate resin | 55.0 | Urethane rubber | 3.0 | 18.3 | A | 5 |
| Example 6 | 6 | Polyester resin | 55.0 | Urethane rubber | 3.0 | 18.3 | A | 5 |
| Example 7 | 7 | Polyarylate resin | 55.0 | Urethane rubber | 3.0 | 18.3 | A | 5 |
| Example 8 | 8 | Bisphenol Z polycarbonate resin | 55.0 | Urethane rubber | 3.0 | 18.3 | A | 4 |
| Example 9 | 9 | Polycarbonate resin | 55.0 | Urethane rubber | 4.7 | 11.7 | A | 5 |
| Example 10 | 10 | Bisphenol Z polycarbonate resin | 55.0 | Urethane rubber | 4.7 | 11.7 | A | 5 |
| Example 11 | 11 | Bisphenol Z polycarbonate resin | 60.0 | Urethane rubber | 3.1 | 19.4 | A | 4 |
| Example 12 | 12 | Bisphenol Z polycarbonate resin | 60.0 | Urethane rubber | 5.2 | 11.5 | A | 5 |
| Example 13 | 13 | Bisphenol Z polycarbonate resin | 65.0 | Urethane rubber | 3.4 | 19.1 | A | 4 |
| Example 14 | 14 | Bisphenol Z polycarbonate resin | 65.0 | Urethane rubber | 5.5 | 11.8 | A | 5 |
| Example 15 | 15 | Bisphenol Z polycarbonate resin | 70.0 | Urethane rubber | 3.6 | 19.4 | A | 4 |
| Example 16 | 16 | Bisphenol Z polycarbonate resin | 70.0 | Urethane rubber | 6.0 | 11.7 | A | 5 |
| Example 17 | 17 | Bisphenol Z polycarbonate resin | 50.0 | Silicone rubber | 4.2 | 11.9 | A | 5 |
| Example 18 | 18 | Bisphenol Z polycarbonate resin | 50.0 | Nitrile rubber | 2.6 | 19.2 | A | 4 |
| Comparative example 1 | C1 | Bisphenol Z polycarbonate resin | 40.0 | Urethane rubber | 2.0 | 20.0 | A | 2 |
| Comparative example 2 | C1 | Bisphenol Z polycarbonate resin | 40.0 | Urethane rubber | 3.5 | 11.4 | B | 3 |
| Comparative example 3 | 1 | Bisphenol Z polycarbonate resin | 45.0 | Urethane rubber | 2.2 | 20.5 | A | 2 |
| Comparative example 4 | 1 | Bisphenol Z polycarbonate resin | 45.0 | Urethane rubber | 4.0 | 11.3 | B | 3 |
| Comparative example 5 | 3 | Bisphenol Z polycarbonate resin | 50.0 | Urethane rubber | 2.5 | 20.0 | A | 3 |
| Comparative example 6 | 3 | Bisphenol Z polycarbonate resin | 50.0 | Urethane rubber | 4.4 | 11.4 | B | 3 |
| Comparative example 7 | 5 | Polycarbonate resin | 55.0 | Urethane rubber | 2.7 | 20.4 | A | 3 |
| Comparative example 8 | 8 | Bisphenol Z polycarbonate resin | 55.0 | Urethane rubber | 2.7 | 20.4 | A | 2 |
| Comparative example 9 | 5 | Polycarbonate resin | 55.0 | Urethane rubber | 5.0 | 11.0 | B | 3 |
| Comparative example 10 | 8 | Bisphenol Z polycarbonate resin | 55.0 | Urethane rubber | 5.0 | 11.0 | B | 3 |
| Comparative example 11 | 11 | Bisphenol Z polycarbonate resin | 60.0 | Urethane rubber | 5.5 | 10.9 | A | 3 |
| Comparative example 12 | 11 | Bisphenol Z polycarbonate resin | 60.0 | Urethane rubber | 3.0 | 20.0 | B | 3 |
| Comparative example 13 | 13 | Bisphenol Z polycarbonate resin | 65.0 | Urethane rubber | 3.3 | 19.7 | A | 3 |
| Comparative example 14 | 13 | Bisphenol Z polycarbonate resin | 65.0 | Urethane rubber | 5.7 | 11.4 | B | 3 |
| Comparative example 15 | 15 | Bisphenol Z polycarbonate resin | 70.0 | Urethane rubber | 3.5 | 20.0 | A | 1 |
| Comparative example 16 | 15 | Bisphenol Z polycarbonate resin | 70.0 | Urethane rubber | 6.5 | 10.8 | B | 3 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image-forming apparatus comprising:

an electrophotographic photosensitive member including a conductive base and a single-layer photosensitive layer disposed on the conductive base, the single-layer photosensitive layer including a binder resin, a charge-generating material, a hole-transporting material, and an electron-transporting material; and a developing unit including a developing roller that develops an electrostatic latent image formed on a surface of the electrophotographic photosensitive member with a developer including a toner in order to form a toner image, the developing roller being arranged to come into contact with the photosensitive layer, wherein the ratio R/P of the content R [mass %] of the binder resin in the photosensitive layer to the pressing force P [N/mm] at which the developing roller is pressed against the photosensitive layer is 11.5 or more and 19.6 or less, and the content R of the binder resin is 45% by mass or more.

2. The image-forming apparatus according to claim 1, wherein the content R of the binder resin is 45% by mass or more and 70% by mass or less.

3. The image-forming apparatus according to claim 1, wherein the content R of the binder resin is 45% by mass or more and 60% by mass or less.

4. The image-forming apparatus according to claim 1, wherein the pressing force P at which the developing roller is pressed against the photosensitive layer is 2.5 N/mm or more and 6.5 N/mm or less.

5. The image-forming apparatus according to claim 4, wherein the pressing force P at which the developing roller is pressed against the photosensitive layer is 3.0 N/mm or more and 5.5 N/mm or less.

6. The image-forming apparatus according to claim 1, wherein the binder resin is at least one resin selected from the group consisting of a polycarbonate resin, a polyester resin, and a polyarylate resin.

7. The image-forming apparatus according to claim 6, wherein the binder resin is a polycarbonate resin.

8. The image-forming apparatus according to claim 1, further comprising:

a charging unit that charges the surface of the electrophotographic photosensitive member;

an electrostatic latent image-forming unit that forms an electrostatic latent image on the charged surface of the electrophotographic photosensitive member; and a transfer unit that transfers the toner image onto a surface of a recording medium.

9. The image-forming apparatus according to claim 1, wherein the image-forming apparatus does not include a cleaning unit, other than the developing roller, which cleans the surface of the photosensitive member before the photosensitive member is charged.

10. An image-forming method comprising:

using an image-forming apparatus including an electrophotographic photosensitive member including a conductive base and a single-layer photosensitive layer disposed on the conductive base, the single-layer photosensitive layer including a binder resin, a charge-generating material, a hole-transporting material, and an electron-transporting material, and a developing unit including a developing roller that develops an electrostatic latent image formed on a surface of the electrophotographic photosensitive member with a developer including a toner in order to form a toner image, the developing roller being arranged to come into contact with the photosensitive layer, developing an electrostatic latent image formed on the surface of the electrophotographic photosensitive member with a developer including a toner in order to form a toner image, wherein the ratio R/P of the content R [mass %] of the binder resin in the photosensitive layer to the pressing force P [N/mm] at which the developing roller is pressed against the photosensitive layer is 11.5 or more and 19.6 or less, and the content R of the binder resin is 45% by mass or more.

11. The image-forming method according to claim 10, the method further comprising:

charging the surface of the electrophotographic photosensitive member;

forming an electrostatic latent image on the charged surface of the electrophotographic photosensitive member; and transferring the toner image onto a surface of a recording medium.

12. The image-forming method according to claim 10, wherein the image-forming method does not include a cleaning step in which a part of the developer which remains on the photosensitive member is removed with a cleaning blade.

13. The image-forming method according to claim 10, wherein the step of developing an electrostatic latent image formed on the surface of the electrophotographic photosensitive member includes performing cleaning of the photosensitive member.

* * * * *